US005812924A

United States Patent [19]

Shaffer et al.

[11] Patent Number: 5,812,924

[45] Date of Patent: Sep. 22, 1998

[54] METHOD AND APPARATUS FOR A POWDER METALLURGICAL PROCESS

[75] Inventors: William R. Shaffer, Greensburg; Thomas J. Baric, Trafford, both of Pa.; Daniel Danila, Orwell; Robert L. Macabobby, Youngstown, both of Ohio

[73] Assignee: Kennametal Inc., Latrobe, Pa.

[21] Appl. No.: 950,808

[22] Filed: Nov. 4, 1997

Related U.S. Application Data

[63] Continuation of Ser. No. 752,491, Oct. 21, 1996, abandoned.

[51] Int. Cl.[6] ..... B22F 5/00; B22F 3/02

[52] U.S. Cl. ..... 419/2; 419/38; 419/66; 425/78

[58] Field of Search ..... 419/2, 38, 66; 425/78

[56] References Cited

U.S. PATENT DOCUMENTS

| | | | |
|---|---|---|---|
| 3,442,706 | 5/1969 | Derrick | 134/6 |
| 3,929,476 | 12/1975 | Kirby, Jr. et al. | 75/214 |
| 4,026,701 | 5/1977 | Till et al. | 96/1 R |
| 4,169,299 | 10/1979 | Bandoh | 15/312 R |
| 4,486,238 | 12/1984 | Bando | 134/6 |
| 4,534,803 | 8/1985 | Asano et al. | 134/30 |
| 4,552,163 | 11/1985 | Biancalana et al. | 134/100 |
| 4,610,931 | 9/1986 | Nemeth et al. | 428/547 |
| 5,413,671 | 5/1995 | Ketchum | 216/37 |
| 5,437,295 | 8/1995 | Brown et al. | 134/37 |
| 5,451,265 | 9/1995 | Koshinen et al. | 134/8 |
| 5,451,469 | 9/1995 | Gustafson et al. | 428/548 |
| 5,456,118 | 10/1995 | Hines et al. | 73/818 |
| 5,484,468 | 1/1996 | Östlund et al. | 75/236 |
| 5,504,972 | 4/1996 | Tada et al. | 15/404 |
| 5,554,395 | 9/1996 | Hume et al. | 425/549 |
| 5,676,588 | 10/1997 | Frederick et al. | 451/86 |

FOREIGN PATENT DOCUMENTS

| | | |
|---|---|---|
| 2597767 | 10/1987 | France . |
| 29520880 | 7/1996 | Germany . |
| 61-261402 | 11/1987 | Japan . |
| 08127000 | 5/1996 | Japan . |
| 09041002 | 2/1997 | Japan . |
| 2279144 | 12/1994 | United Kingdom . |

OTHER PUBLICATIONS

PCT Search Report mailed 15 Oct. 1997, International Application No. PCT/US97/10547, International Filing Date 16 Jun. 1997.

Pressmatic SA Product Literature for a Picker Arm (1994).

Kennametal® Lathing Tool Catalog 6000, Copyright 1996 by Kennametal Inc., Latrobe, PA by Kennametal Inc., Latrobe, PA.

Kennametal® Lathing Tool Catalog 4000, Copyright 1994 by Kennametal Inc., Latrobe, PA.

American National Standards for Cutting Tools–Indexable Inserts–Identification System, ANSI B212.4–1986, American National Standards Institute, New York, New York (1986).

*Primary Examiner*—Daniel J. Jenkins

*Attorney, Agent, or Firm*—Stanislav Antolin

[57] ABSTRACT

A method of producing a green compact which includes the steps of forming a generally homogeneous powder blend of powder components; consolidating the powder blend into a green body wherein the green body includes a flashing; impinging the green body with a fluid stream so as to dislodge the flashing; and removing the dislodged flashing from the surface of the green body.

50 Claims, 15 Drawing Sheets

METHOD AND APPARATUS FOR A POWDER METALLURGICAL PROCESS

CROSS-REFERENCE TO RELATED PATENT APPLICATION

This patent application is a continuation patent application of U.S. patent application Ser. No. 08/752,491 filed on Oct. 21, 1996 now abandoned.

BACKGROUND

Cutting inserts are typically produced via powder metallurgical techniques. In one typical process, the powder components are first blended into a generally homogeneous blend so as to provide such a powder blend. The powder blend is then placed into a mold (or die cavity) of a press where the powder is subjected to a compressive pressure so as to form the powder blend into a so-called green body, i.e., a mass of particles consolidated to a so-called green (or partial) density which can be in the range of 40% to 75% of the theoretical density. The green body is then consolidated under heat or heat and pressure (e.g., liquid phase sintering) so as to achieve the final density which can be in the range of about 95% to about 100% of theoretical density.

During the course of formation, a volume of material, i.e., a flashing, builds up in the small volume which provides the clearance between the ram of the press and the die wall that defines the die cavity. During the forming (or pressing) process, some of this flashing adheres to the edge of the green body so that the typical green body has a flashing generally at the edges thereof. In the case of a green body for a cutting insert, the flashing extends from the flank faces so as to be above the plane of the rake face. The typical green body also has other powder debris, e.g., powder particles, on the surface thereof. The presence of the flashing and the powder debris on the green body is an undesirable condition.

In the past, someone such as a press operator had to physically brush each green body so as to dislodge the flashing. The operator had to then direct a blast of compressed air toward the green body to blow off the dislodged flashing and other surface debris. While the above technique has had some beneficial effect, there have been some drawbacks therewith.

The brushing technique required that the operator had to first remove the green body and place it on a tray with a plurality of other green bodies. Because the green body had not been consolidated to a final density, it was in a somewhat fragile condition and susceptible to damage caused by physical handling. This was especially true when the green body had the flashing thereon in that the flashing was susceptible to being broken so that the break was not along a common line of fracture. Even if the physical handling of the green body with a flashing did not break the flashing, it was generally the case that physical brushing of the green body broke off the flashing so that the break was not along a common line of fracture. Breakage of the flashing so that the break was not along a common line of fracture resulted in a sintered body that had a cutting edge that needed a meaningful amount of honing so as to accommodate for the breakage below the land.

After completion of the brushing step, the operator then blasted the green body with a blast of compressed air to blow off the previously dislodged flashing and the surface debris. Because the air blast was done by an operator to a plurality of green bodies on a tray, the blast of air may not have uniformly impinged the green bodies so that some green bodies may still have had previously dislodged or broken flashing and debris thereon.

It becomes apparent that certain drawbacks exist with respect to the earlier ways to deflash a green body. It would be advantageous to provide an apparatus, as well as a method, for deflashing a green body (or preparing a green body for subsequent consolidation) that breaks the flashing in a common line of fracture.

SUMMARY

In one form thereof, the invention is a method of producing a body comprising the steps of: providing a generally homogeneous powder blend of powder components; forming the powder blend into a partially dense body wherein the partially dense body includes a flashing; and impinging the partially dense body with a fluid stream so as to dislodge the flashing.

In another form thereof, the invention is an apparatus for treating a partially dense body having a flashing wherein the partially dense body is formed by a press. The apparatus comprises a housing that defines a fluid entrance chamber and a treating chamber. The housing has an opening through which the treating chamber receives the partially dense body. The fluid entrance chamber is in communication with a source of a fluid stream. The fluid entrance chamber is in communication with the treating chamber so that the fluid stream entering the fluid entrance chamber passes into the treating chamber thereby impinging upon the partially dense body so as to break the flashing.

BRIEF DESCRIPTION OF THE DRAWINGS

The following is a brief description of the drawings of the present patent application.

DETAILED DESCRIPTION

Figure 1:
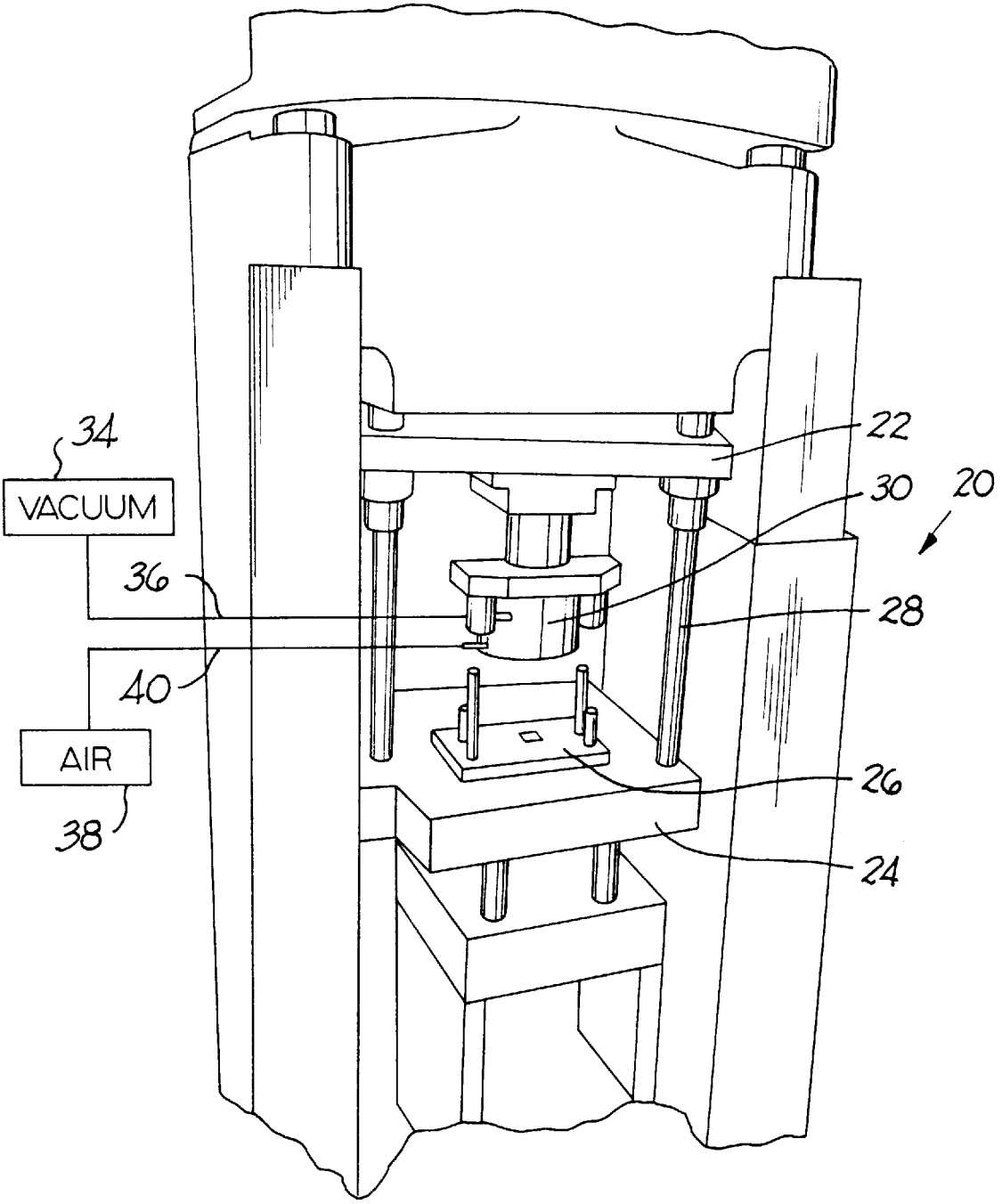
FIG. 1 is an isometric view of one specific embodiment of a deflasher connected to a press.

Referring to the drawings, FIG. 1 illustrates a press 20 that has a top head 22, a lower platen 24 with a table 26 thereon and guide posts 28 extending upwardly from the table 26. A deflasher 30 is connected to the top head 22 and functions in conjunction with the operation of the press 20 as will be discussed in detail hereinafter.

Figure 2:
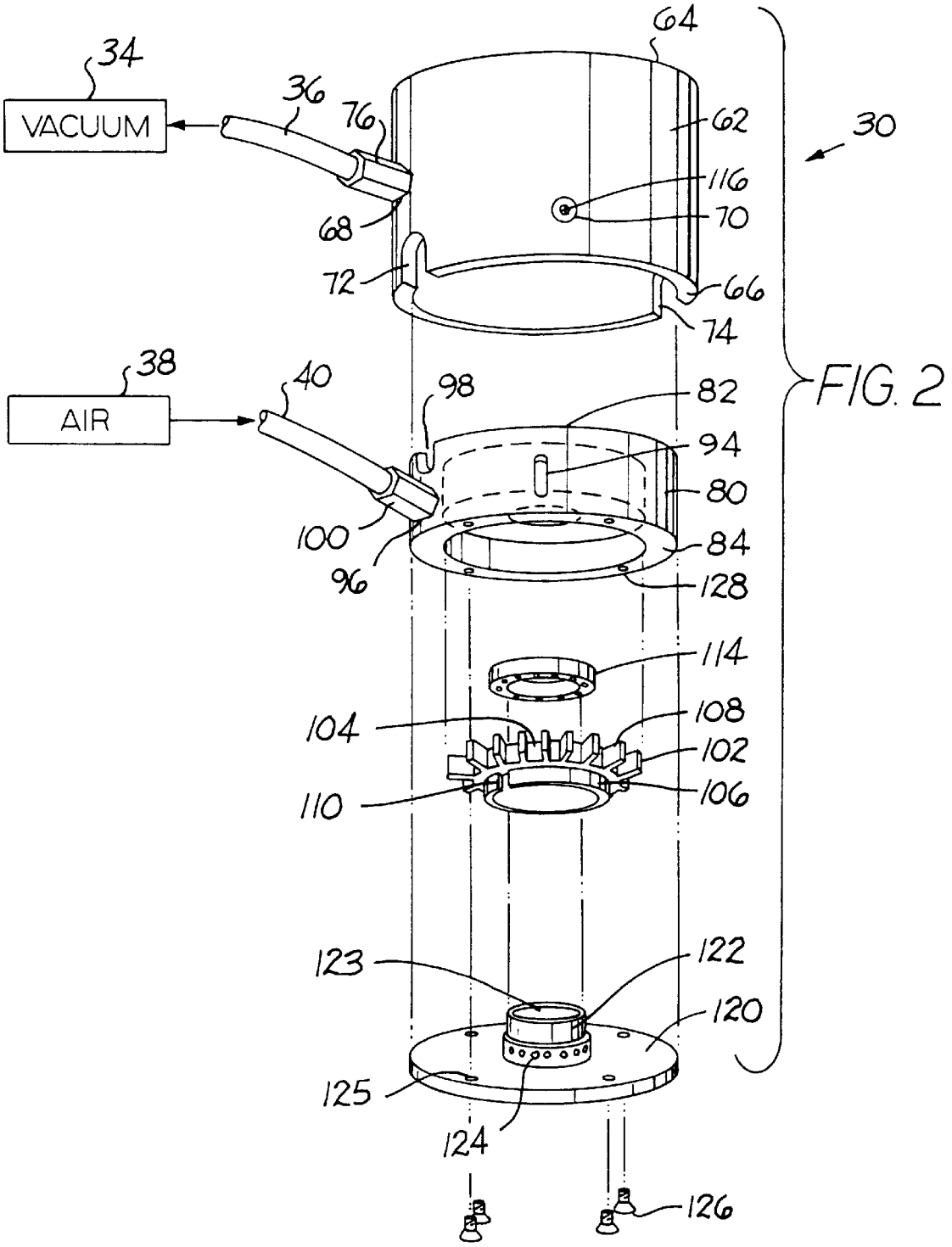
FIG. 2 is an isometric view of the deflasher of FIG. 1 wherein the components are exploded apart.
Figure 3A:
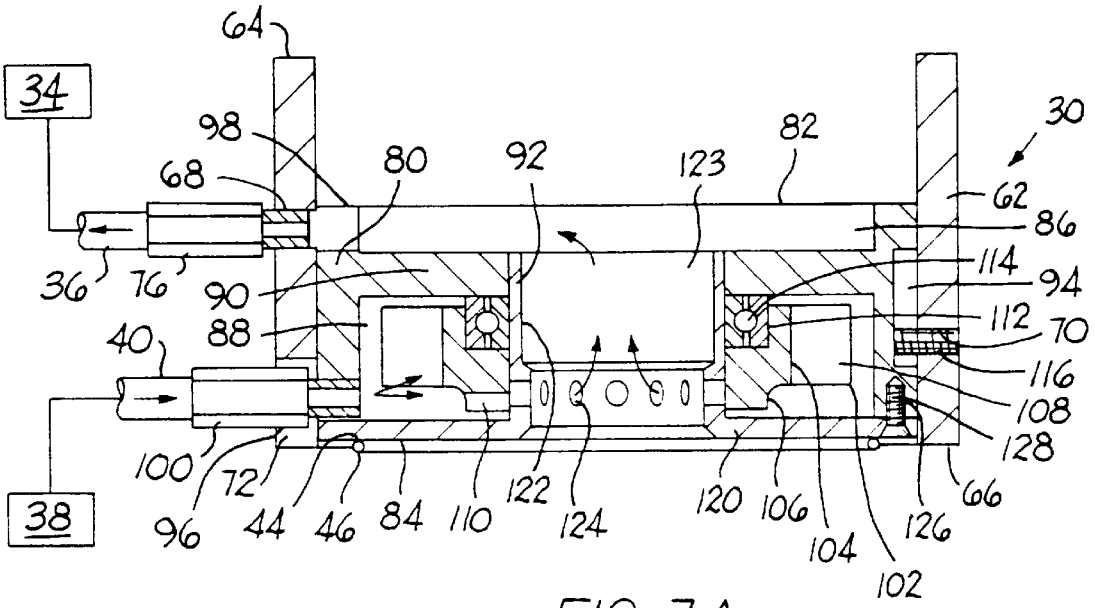
FIG. 3A is a cross-sectional view of the deflasher of FIG. 2 wherein the deflasher is in a compressed condition.
Figure 3B:
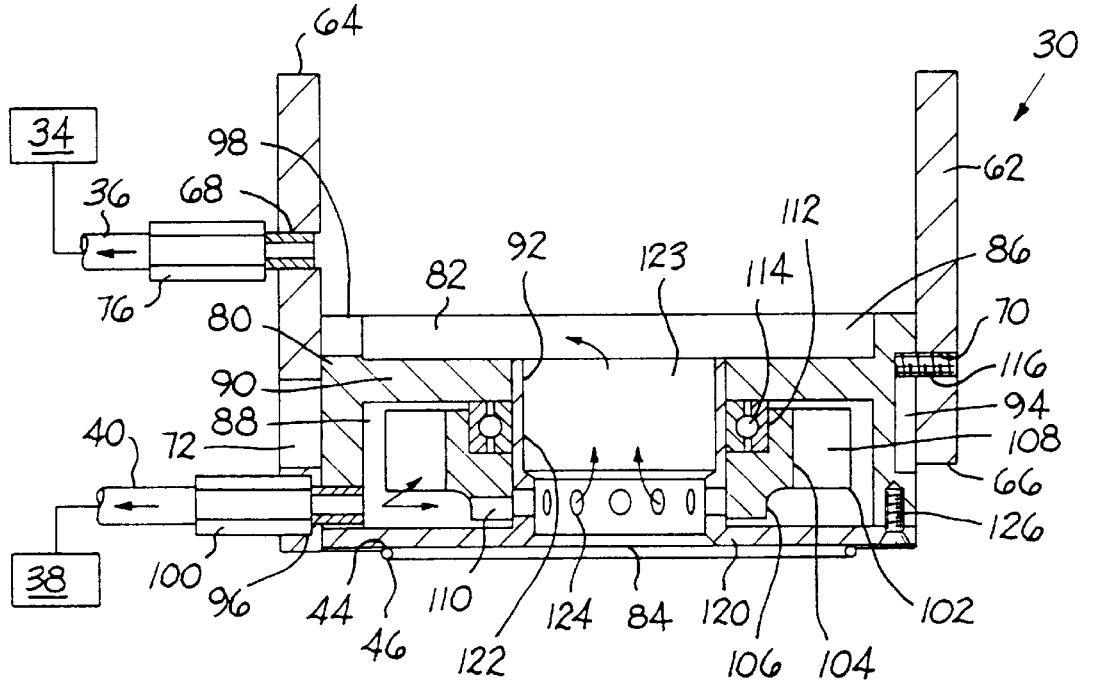
FIG. 3B is a cross-sectional view of the deflasher of FIG. 2 wherein the deflasher is in an expanded condition.

Referring to FIGS. 2, 3A, and 3B, deflasher 30 includes a generally cylindrical housing 62 which has a top end 64 and a bottom end 66. Housing 62 contains a port 68, an aperture 70, and two slots (72, 74) in the wall of the housing 62. Slots 72 and 74 are open at the bottom end 66 of housing 62. A fitting 76 attaches to the housing 62 at port 68. Hose 36 extends from fitting 76 and connects the deflasher 30 with a source of vacuum schematically illustrated as 34.

Deflasher 30 also includes a slider member 80 which has a top end 82 and a bottom end 84. As illustrated in FIGS. 3A and 3B, slider 80 also defines a top interior volume 86 and a bottom interior volume 88 wherein an interior wall 90 separates the interior volume of the slider into these top and bottom interior volumes (86, 88). Wall 90 contains a centrally located opening 92 therein. Slider 80 also includes a blind slot 94 in the exterior surface of the side wall thereof, as well as a port 96. Slider 80 contains a notch 98 near the top end thereof. A fitting 100 connects to the slider 80 at the port 96. A hose 40 extends away from fitting 100 and connects deflasher 30 with a source of compressed air schematically illustrated as 38 (see FIG. 2).

Deflasher 30 also has a rotor 102 which has an enlarged diameter hub portion 104 and a reduced diameter hub portion 106. Rotor 102 includes a plurality of radially outwardly extending vanes 108. The reduced diameter hub portion 106 contains an opening 110. The enlarged diameter hub portion 104 contains an annular channel 112. A bearing 114 fits within the channel 112. A pin 116 extends through aperture 70 so as to engage the blind slot 94 in a slidable fashion, i.e., so that the slider 80 can move (slide) relative to the housing 62.

Deflasher 30 includes a bottom cover 120 which has a central upstanding cylindrical wall 122 that defines a central volume 123. The cylindrical wall 122 contains a plurality of apertures 124 that provide communication with the central volume 123. The bottom cover 120 contains a plurality of holes 125 near the periphery thereof. Screws 126 pass through the holes 125 so as to engage the threaded apertures 128 in the bottom surface (or end) 84 of the slider 80. The bottom cover 120 further contains an annular notch 44 which receives an O-ring 46. As will be described hereinafter, the O-ring 46 seals against the table 26 during the deflashing operation. It can be appreciated that the cylindrical wall 122 divides the bottom interior volume 88 into a fluid entrance chamber and a treating chamber wherein the treating chamber is defined by the central volume 123. As will be discussed hereinafter, the fluid stream enters the fluid entrance chamber and then passes into the treating chamber wherein the fluid stream impinges the green body. It should also be appreciated that the interior volume of the housing that communicates with the vacuum source defines an evacuation chamber through which the broken flashing and debris may be removed from the proximity of the green body.

Figure 4A:
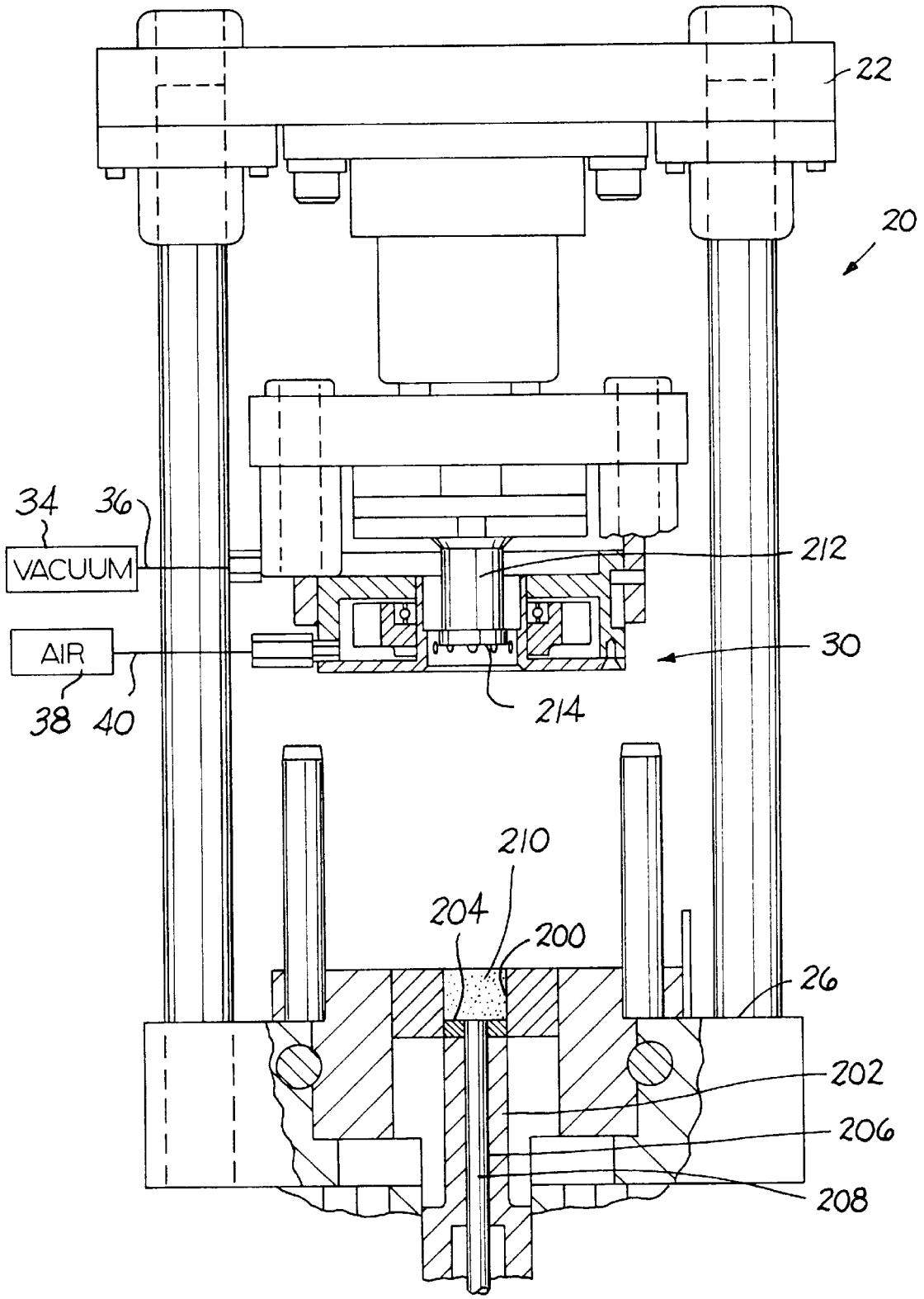
FIG. 4A is a side view of a portion of the press and deflasher of FIG. 1 with selected portions illustrated in cross-section, and wherein the lower die cavity has loose powder therein.

Referring to the operation of the deflasher 30 in conjunction with the press 20, FIG. 4A illustrates the deflasher 30 as attached to the press 20 in a position that corresponds to the loose powder being first deposited into the die cavity 200. The die cavity 200 is found in the table 26. A lower ram 202 is slidably positioned within the die cavity. Lower ram 202 includes a top face 204. Lower ram 202 may include a bore 206 that may includes a slidable projection 208 therein. The loose powder mass 210 occupies the volume in the die cavity 200 between the top face 204 of the lower ram 202 and the top edge of the die cavity (which is coplanar with the surface of the table 26). The press 20 further includes an upper ram 212 connected to the top head 22 so as to be movable in a generally vertical direction. The upper ram 212 presents a bottom face 214. The bottom face 214 of the upper ram 212 and the top face 204 of the bottom 202 each may present a contour that corresponds to a particular geometry of the cutting insert.

Figure 4B:
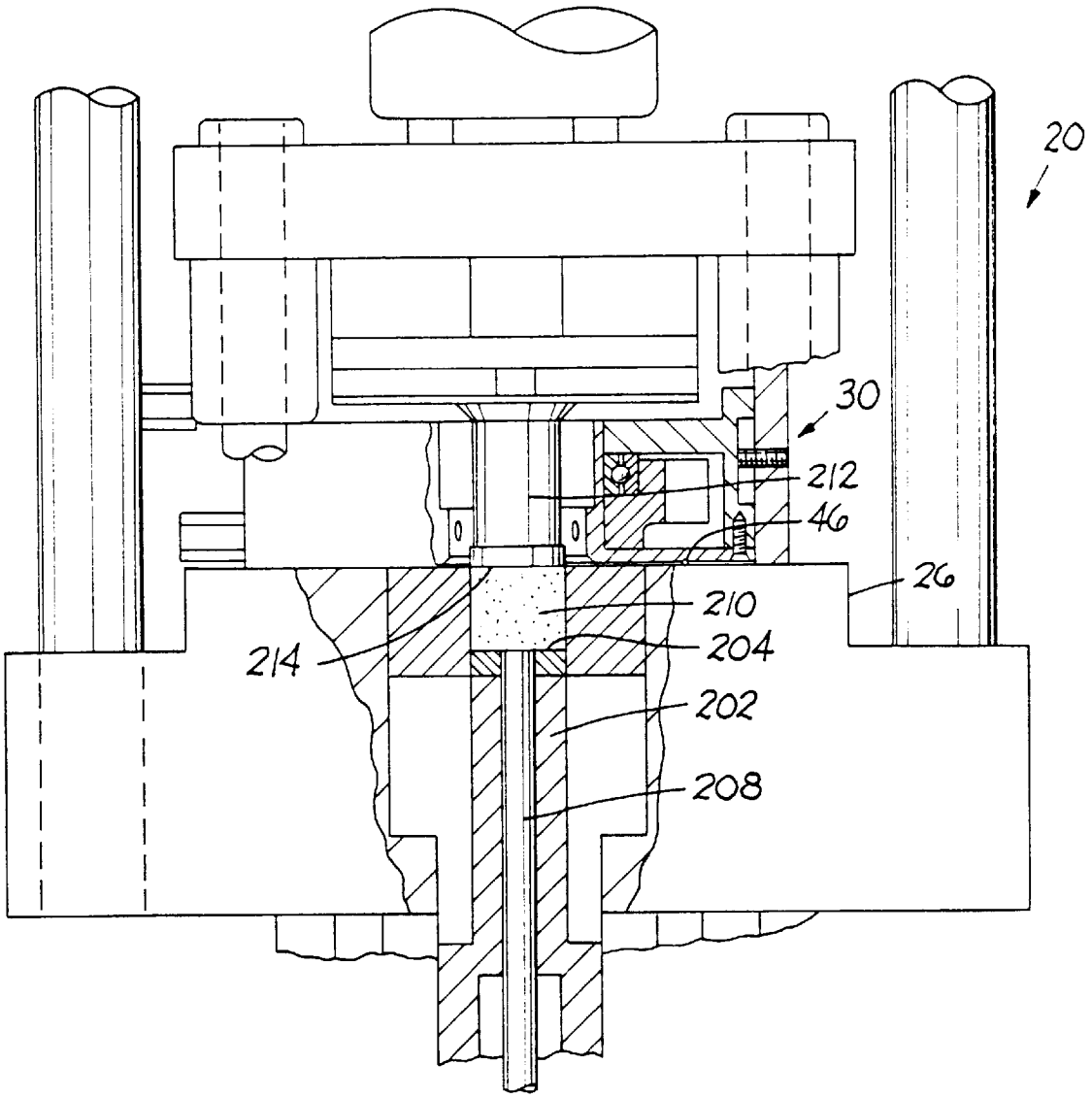
FIG. 4B is an enlarged side view of the press and deflasher of FIG. 4A illustrating the upper ram assembly beginning to penetrate the die table.

FIG. 4B depicts the deflasher 30 in a position prior to the compaction of the loose powder mass 210. The deflasher 30 rests on the surface of the table 26 and the bottom face 214 of the upper ram 212 lightly contacts the loose powder mass 210. The deflasher 30 is in its so-called compressed condition that corresponds to the condition of the deflasher 30 as shown in FIG. 3A. The deflasher 30 also seals against the table 26 via the O-ring 46.

Figure 4C:
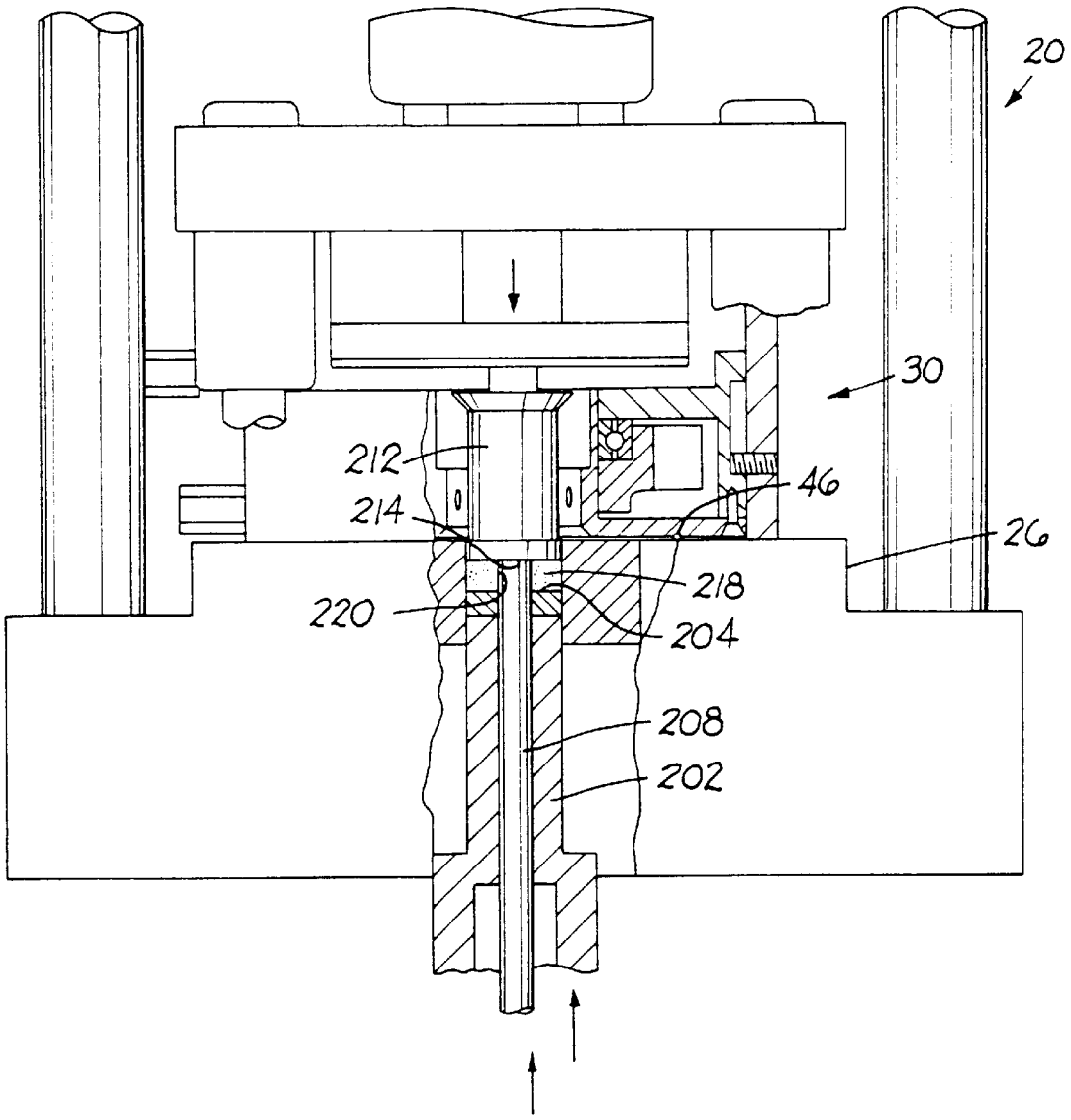
FIG. 4C is an enlarged side view of the press and deflasher of FIG. 4A illustrating the upper ram and the bottom ram moving toward each other thereby compressing the powder in the die cavity.

FIG. 4C shows the deflasher 30 in a position where it remains resting on the surface of the table 26. The upper ram 212 has moved downwardly and the lower ram 202 has moved upwardly so that together they have compressed the loose powder mass into a green body 218. The slidable projection 208 has moved upwardly where it abuts the bottom face 214 of the upper ram 212 so as to form a central aperture 220 in the green body 218. The green body 218 comprises a partially dense mass of the powder components that comprised the powder mass 210.

Figure 4D:
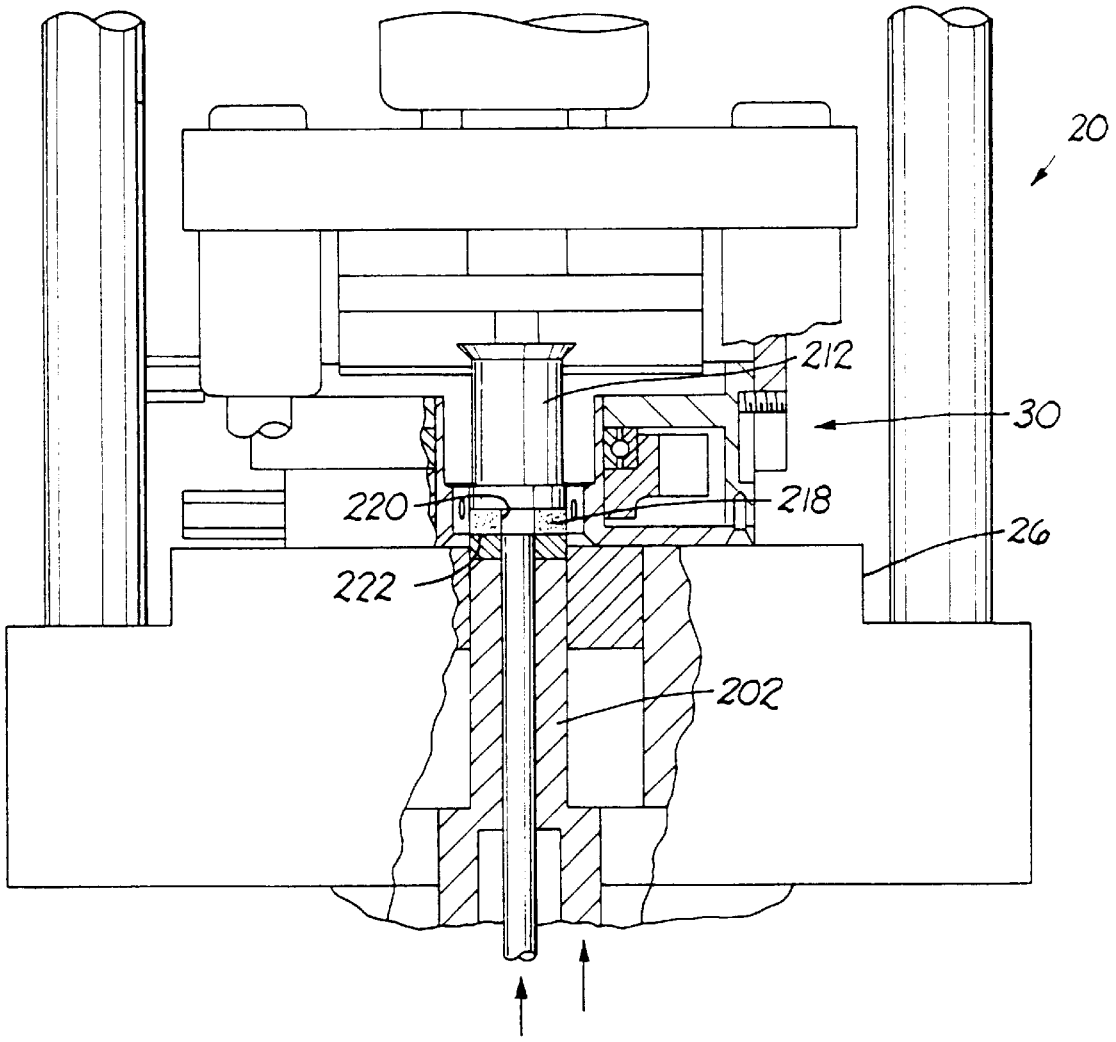
FIG. 4D is an enlarged side view of the press and deflasher of FIG. 4A illustrating the pressed green body being subjected to the deflashing operation.

FIG. 4D depicts the deflasher 30 in a position where the table 26 has moved downwardly relative to the green body 218. The extent of the downward movement is such so as to expose the green body 218 wherein the bottom surface 222 of the green body 218 is coplanar with, or slightly above, the horizontal plane of the table 26. The green body 218 is held in place by the slight downward force of the upper ram 212 so as to sandwich the green body 218 between the upper ram 212 and the lower ram 202. When the green body 218 is in this position it may be subjected to the deflashing treatment.

Referring to the deflashing operation, compressed air flows from the compressed air source 38 through line (or hose) 40 into the deflasher 30 via fitting 100 attached to the port 96. The compressed air enters into the bottom volume 88 of the slider 80. The compressed air then continues on so as to impinge upon the rotor 102, which causes the rotor 102 to rotate at a relatively high speed. The compressed air passes through the opening 110 in the reduced diameter hub portion 106 toward the apertures 124 in the cylindrical wall projection 122 of the bottom cover 120.

Because there is only one opening 110 through which the compressed air sequentially passes into a plurality of apertures 124 as the rotor 102 rotates, the air that enters into the cylindrical volume 123 is pulsating. This pulsating stream of air impinges upon the green body in such a fashion and with such force so as to dislodge the flashing and any surface debris on the green body. While the specific embodiment uses only one opening 110 to impinge compressed air on the surface of the green body, the inventors contemplate the use of a plurality of openings of various configuration depending upon the application. Also, while the specific embodiment uses compressed air to impinge the surface of the green body, the inventors contemplate the use of other fluids. For example, a liquid, a gas, a liquid and a gas, a gas with entrained particles therein, a liquid with entrained particles therein, or a liquid and a gas with entrained particles therein, would be suitable for use. While the specific fluid may vary upon the application, it should be appreciated that the fluid should not leave a residue that could adversely impact upon the consolidation (e.g., sintering) of the green body. The inventors also contemplate that the fluid stream that impinges the green body could be continuous (or steady) in nature.

As an optional feature of the deflasher 30 (and the deflashing operation), the vacuum source 34 exerts a vacuum on the top volume 86 of the slider 80 through the hose 36. The loosened (or dislodged) flashing and other debris then is carried out of the deflasher 30 by the vacuum. The flashing and debris can then be collected in a collector and discarded, or reused, if so desired.

Figure 4E:
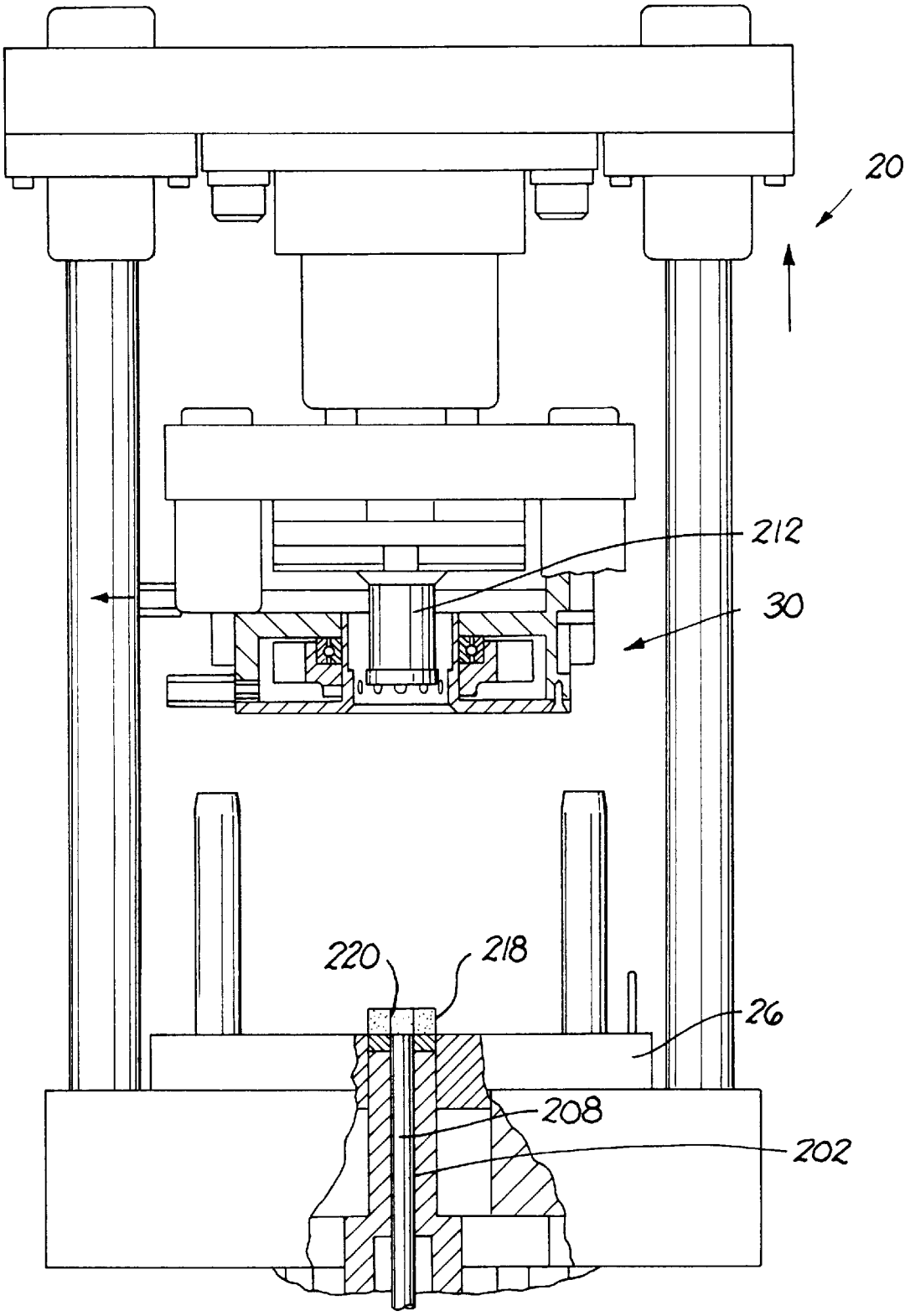
FIG. 4E is a side view of a portion of the press and deflasher of FIG. 1 with selected portions illustrated in cross-section, and wherein the pressed green body has been subjected to the deflashing operation and is ready to be transferred to the tray.

FIG. 4E shows the press 20 and deflasher 30 in a condition in which the upper ram 212 has moved away from the deflashed green body 218. The deflashed green body 218 is now ready for removal from the table 26 so that the press 20 can repeat the above operation of forming a green body 218.

As a result of the deflashing process, the green body has a flashing that is broken along a common line of fracture. Furthermore, it is preferable if, in addition to the flashing being broken along a common line of fracture, the flashing is not broken below the land of the green body.

Figure 10:
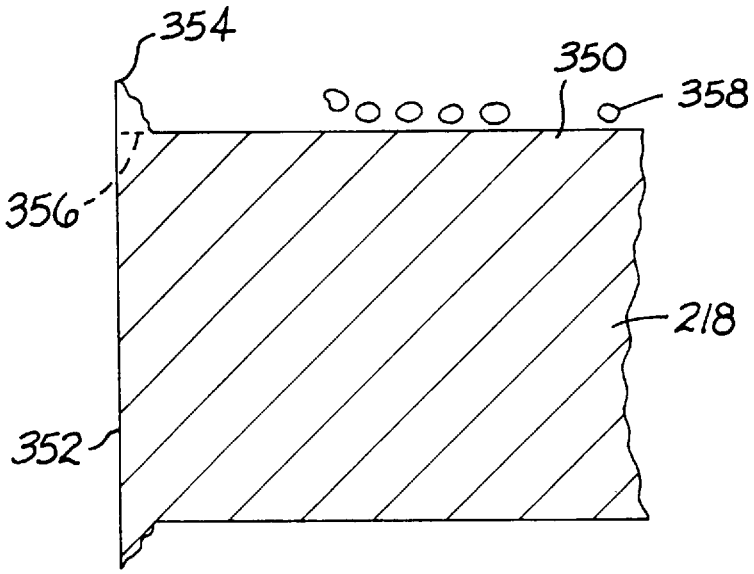
FIG. 10 is a side cross-sectional view of a portion of a green body wherein there is flashing at the cutting edges of the green body.
Figure 11:
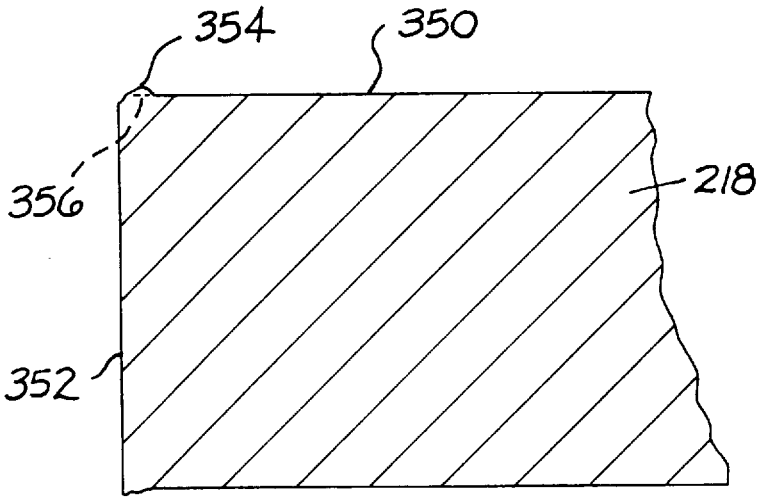
FIG. 11 is side cross-sectional view of a portion of a green body wherein there the flashing has been broken above the land and other debris has been removed from the green body.

In this regard referring to FIGS. 10 and 11, FIG. 10 illustrates a green body 218 that has a rake face 350 and a flank face 352, as well as a flashing 354 which extends upwardly past the horizontal plane of the rake face 350. The land is represented by the dashed line 356, and is the extension of the plane of the rake face 350 through the flashing 354. Green body 218 further includes surface debris 358 on the rake face 350 thereof. FIG. 11 depicts the green body 218 after the deflashing operation wherein the flashing 354 has been broken off above the land (dashed line 356) and the surface debris 358 removed from the rake face 350 of green body 218. Upon consolidation (e.g., sintering) the volume of the remaining flashing 354 shrinks so that there is less flashing to deal with after consolidation than before consolidation.

Because the flashing is broken along a common line of fracture, the flashing can be removed from the as-sintered cutting insert with a hone of a consistent radius. This is the case because the size of the hone is not dictated by the largest degree of breakage along a line of fracture that is not common. By avoiding a honing operation that must accommodate for the largest degree of breakage, less honing is necessary to hone the cutting edge of the as-sintered (or consolidated) body.

Figure 5:
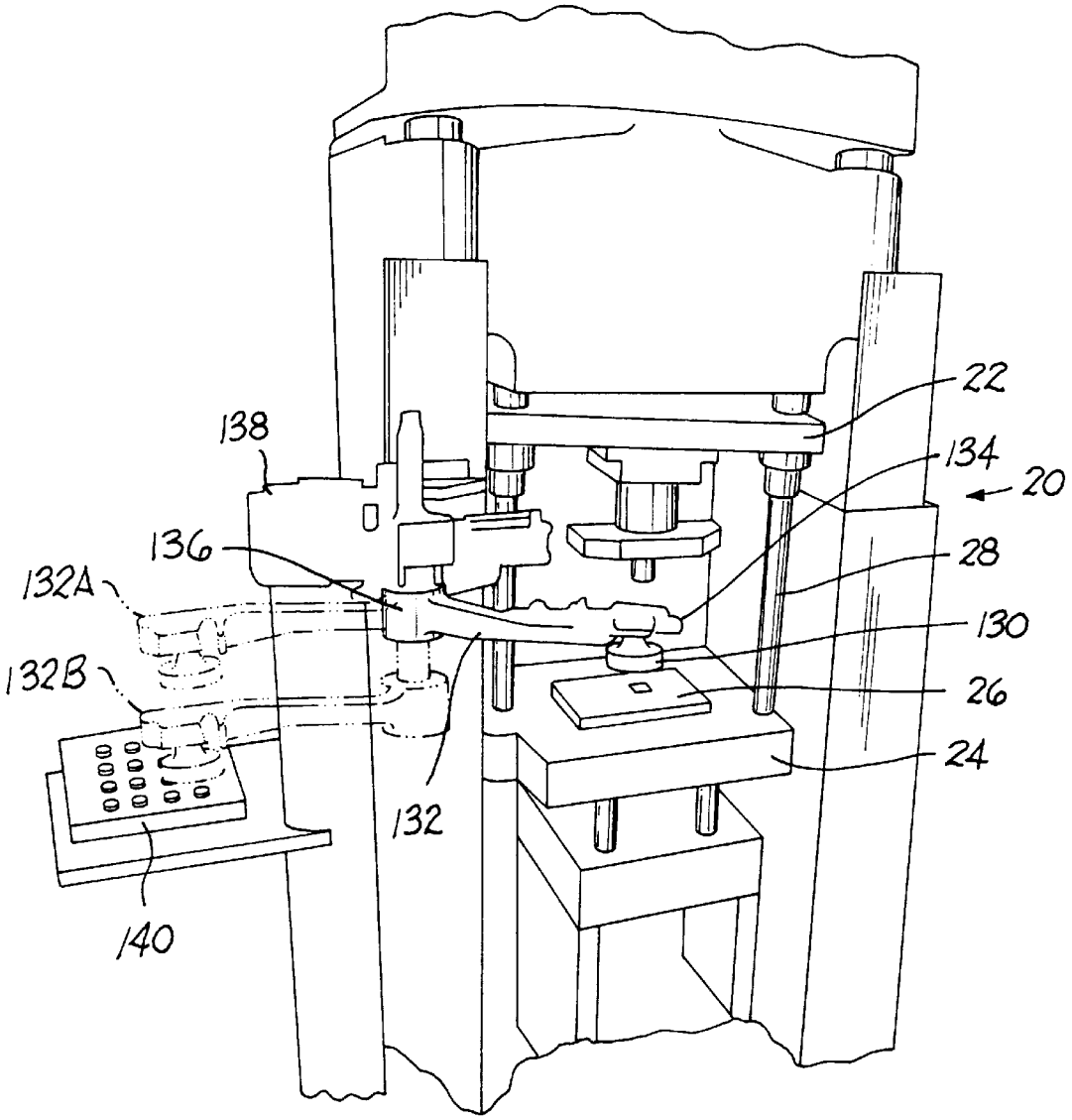
FIG. 5 is an isometric view of a press and a picker arm wherein another specific embodiment of a deflasher is attached to the picker arm.
Figure 6A:
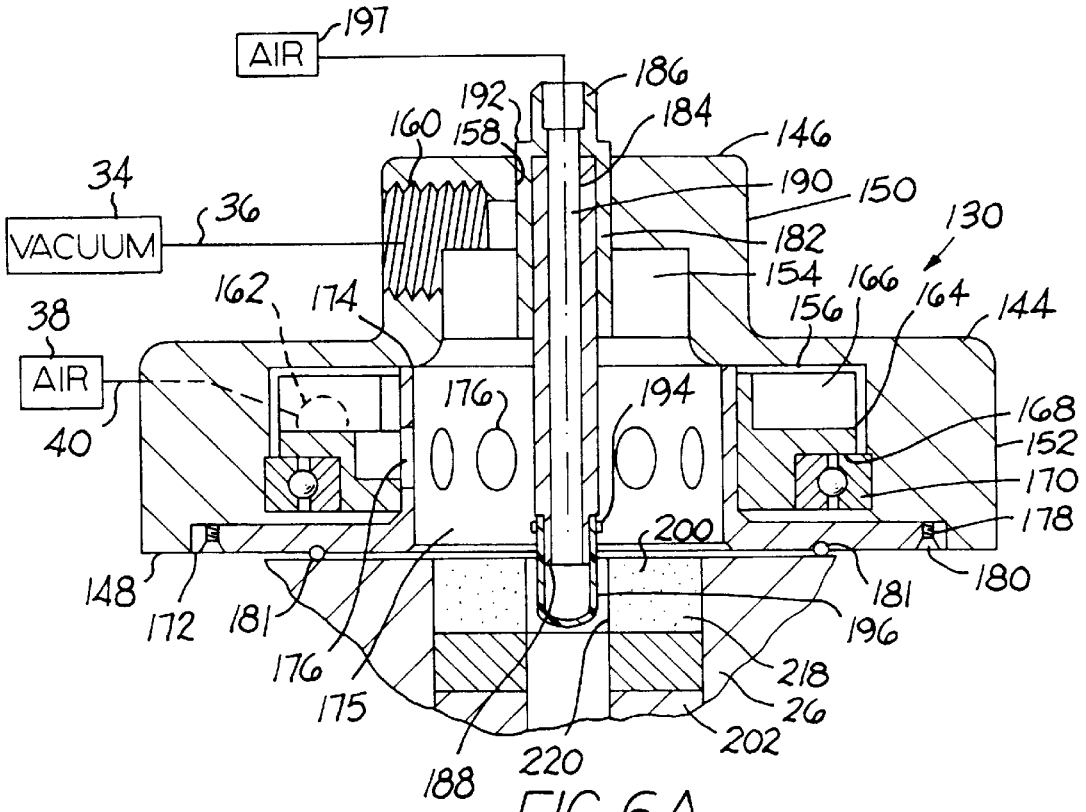
FIG. 6A is a side view of the deflasher of FIG. 5, with a portion illustrated in cross-section, in a condition in which the green body is outside of the deflasher.
Figure 6B:
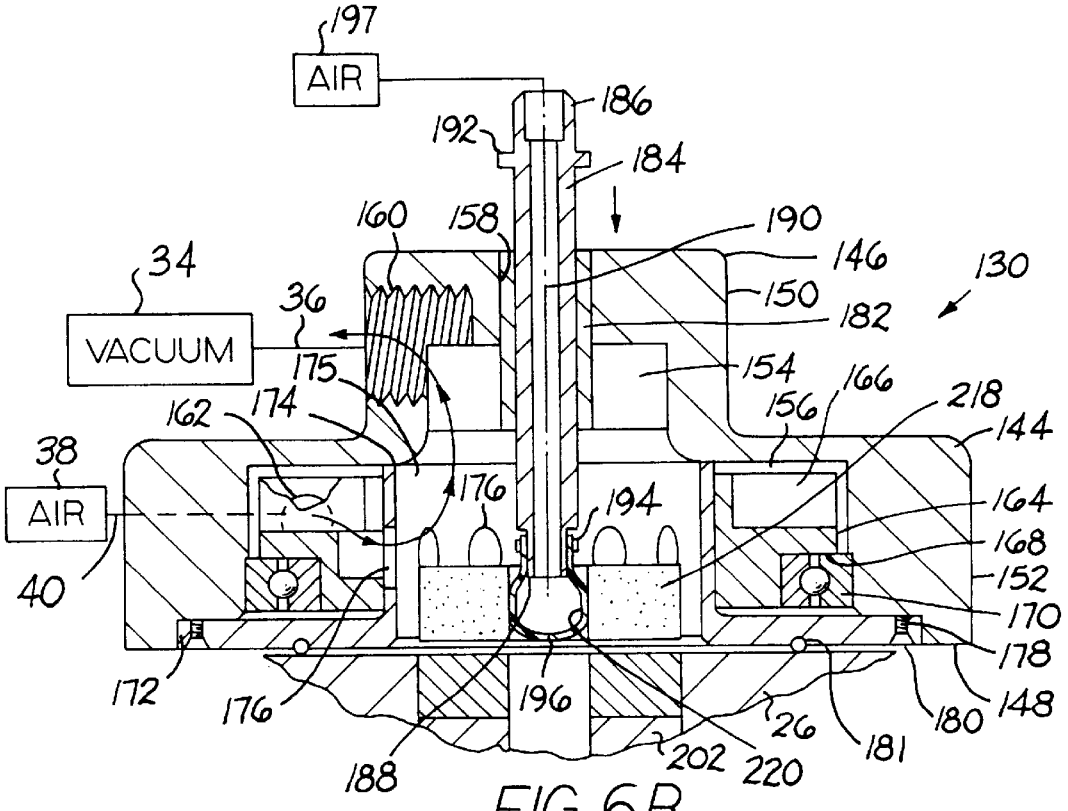
FIG. 6B is a side view of the deflasher of FIG. 5, with a portion illustrated in cross-section, in a condition wherein the green body is in position to be deflashed.

Referring to FIGS. 5, 6A, and 6B, another specific embodiment of a deflasher 130 is depicted for use in conjunction with a press 20. The press 20 includes a top head 22, a lower platen 24 with a table 26 thereon and guide posts 28 extending upwardly from the table 26.

There is a picker arm assembly for use in conjunction with the press. The picker arm assembly includes a picker arm 132 which has a distal end 134 to which the deflasher 130 is connected. Picker arm 132 has another end 136 which is movably connected to a mover 138 so that the picker arm 132 may rotate and move up and down relative to the press 20. In this regard, the picker arm assembly as shown by broken lines as being rotated so that the picker arm 132A is positioned over a tray 140. This figure also illustrates the picker arm 132B being proximate to the tray 140 so as to place a green body 218 on the tray 140. The use of the picker arm 132 allows the automatic transfer of the green bodies 218 (which may be deflashed prior to and/or during and/or subsequent to a transfer) from the table 26 to a tray 140.

Deflasher 130 comprises a housing 144 which has a top end 146 and a bottom end 148. Housing 144 presents a reduced diameter portion 150 and an enlarged diameter portion 152. The reduced diameter portion 150 of the housing defines an upper interior volume 154. The enlarged diameter portion 152 of the housing defines a lower interior volume 156. Housing 144 includes an aperture 158 in the top end 146 thereof. The reduced diameter portion 150 of the housing may include a vacuum port 160 through which line 36 connects vacuum source 34 to the deflasher 130. The enlarged diameter portion 152 of the housing includes an air port 162 through which line 40 connects air source 38 to the deflasher 130.

Deflasher 130 includes a rotor 164 which presents a plurality of radially outwardly extending vanes 166. Rotor 164 also includes a shoulder 168. A bearing 170 is positioned against shoulder 168.

Deflasher 130 also includes a bottom cover 172 which presents an upstanding cylindrical wall 174 that defines a cylindrical volume 175. Cylindrical wall 174 contains a plurality of passages 176. Bottom cover 172 contains a plurality of holes 178 through which pass respective screws 180 so as to connect the bottom cover 172 to the housing 144. Bottom cover 172 may have a channel which receives an O-ring 181. As described hereinafter, the O-ring 181 effects a seal between the deflasher 130 and the table 26 during the deflashing operation.

Deflasher 130 also includes a cylindrical bushing 182 which fits within aperture 158 in the top of the housing 144. A fixture pin 184 is slidably positioned within the longitudinal bore of the bushing 182. Fixture pin 184 has a top end 186 and a bottom end 188, as well as a longitudinal bore 190. The exterior surface of the pin 184 presents an annular shoulder 192. There are threads 194 in the exterior surface of the pin 184 adjacent to the bottom end 188 thereof. A bladder 196 is threadedly attached to the fixture pin 184 via the threads 194.

In operation, the press presses (i.e., compresses or forms) the loose powder mass in the same way as described in conjunction with deflasher 30. The end result is that a green body 218, which has flashing (see flashing 354 in FIG. 10) and surface debris (see debris 358 in FIG. 10), is positioned on the table 26 of the press 20 much like that shown in FIG. 4E. The picker arm 132 then moves over so that the fixture pin 184 is aligned over the central aperture 220 in the green body 218 (i.e., the central longitudinal axis of the picker arm 132 is coaxial with the central vertical axis of the aperture 220 in the green body 218). At this point in the process, the bladder 196 is deflated (i.e., contracted). It should be appreciated that any one of a number of retention assemblies could retain the green body for subsequent deflashing. For example, a vacuum cup or a mechanical gripper would be suitable to retain the green body, especially in those cases in which the green body does not contain a central aperture.

The deflasher 130, along with the fixture pin 184, then moves downwardly so that the deflated bladder 196 on the fixture pin 184 is within the volume of the central aperture 220 of the green body 218. FIG. 6A illustrates the fixture pin 184 in this position, as well as the deflasher 130 being in contact with the table of the press so as to form a seal therebetween via O-ring 181.

An air source 197 provides air to the bore 190 of the fixture pin so as to inflate, i.e., expand, the bladder 196 so that it engages the walls that define the central aperture 220 of the green body 218. The inflated bladder 196 securely holds the green body 218. The green body 218 is now in a position to start the deflashing operation wherein the compressed air impinges upon the green body 218 to dislodge the flashing and other surface debris. Optionally, the vacuum draws the dislodged flashing and other debris away for collection.

Referring to the deflashing operation using deflasher 130, the compressed air enters via air port 162 into the lower interior volume 156. The compressed air continues on to impinge upon the rotor 164 (and specifically the rotor vanes 166) which causes the rotor 164 to rotate at a relatively high speed. The air passes into the reduced diameter hub portion of the rotor and through the passages 176 of the cylindrical wall 174 so as to cause a pulsating stream of air to impinge upon the green body 218. The impingement of the air upon the green body 218 loosens any debris and breaks the flashing above the land. In those cases in which a vacuum is used, the vacuum exerts a force on the upper interior volume 154 of the housing 144 so that the flashing and debris are drawn out of the deflasher 130 for collection and disposal (if desired).

Upon completion of the deflashing operation, the picker arm 132 then carries the deflashed green body 218 over to the tray 140 and places the green body 218 thereon. The tray 140 (with a plurality of green bodies 218 thereon) is then transported to a sintering furnace for subsequent consolidation by a process such as, for example, liquid phase sintering.

Figure 7:
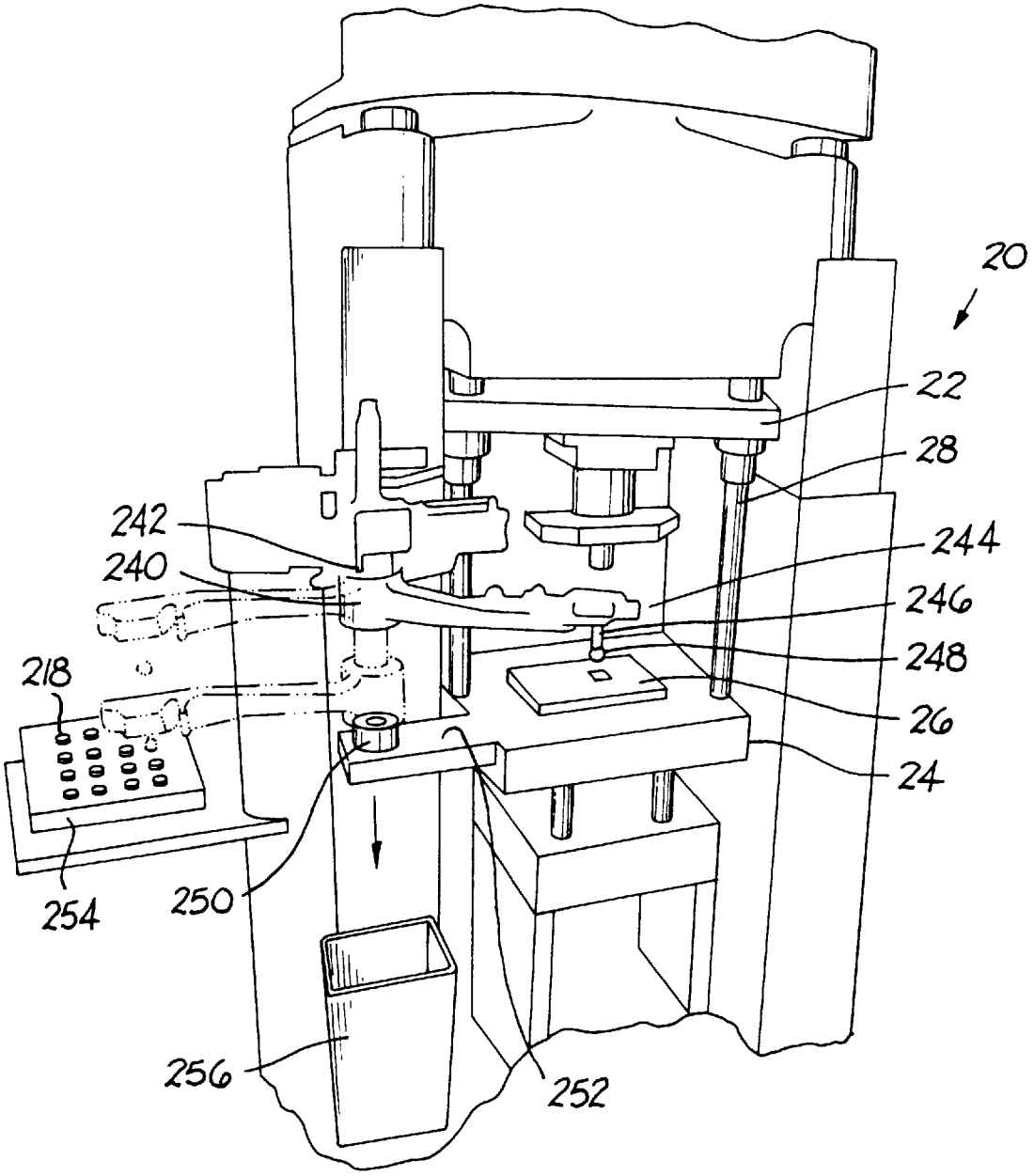
FIG. 7 is an isometric view of another specific embodiment of a deflasher that is independent of the press and the picker arm.

Referring to FIG. 7, there is shown the press 20 which includes the top head 22, the lower platen 24 with the table 26 thereon, and the guide posts 28. A picker arm 240 is connected to and functions in cooperation with press 20. Picker arm 240 has one end 242 pivotally connected to the press and the distal end 244 thereof has connected thereto an assembly which includes a fixture pin 246 which has an inflatable bladder 248 at the lower end thereof. The fixture pin 246 and bladder 248 are structurally similar to the fixture pin 184 and bladder 196 as shown in FIGS. 6A and 6B.

FIG. 7 further includes another embodiment of a deflasher 250. Deflasher 250 is independent from the press 20 and the picker arm 240, i.e., the deflasher 250 is not directly connected or attached to the picker arm 240 or the press 20. The deflasher 250 rests upon a tray 252 so as to be over a hole (not illustrated) in the tray 252. However, it is contemplated that deflasher 250 could be positioned relative to the picker arm 240 in any one of a number of ways. The assembly depicted in FIG. 7 further includes a tray 254 on which the deflashed green bodies 218 are placed prior to transport to the sintering operation. A disposal bin 256 is directly beneath the deflasher 250.

Figure 8:
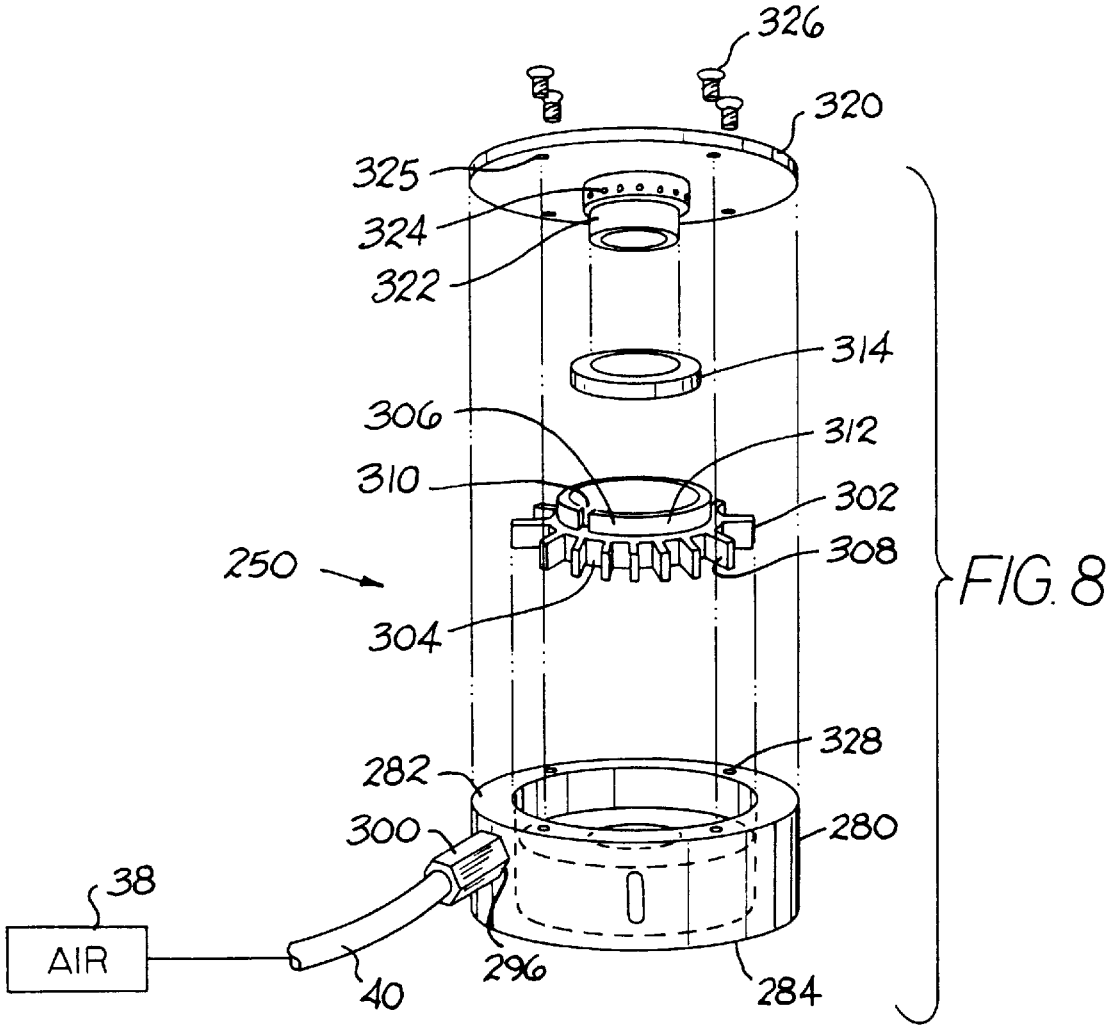
FIG. 8 is an isometric view of the deflasher of FIG. 7 wherein the components are exploded apart.
Figure 9:
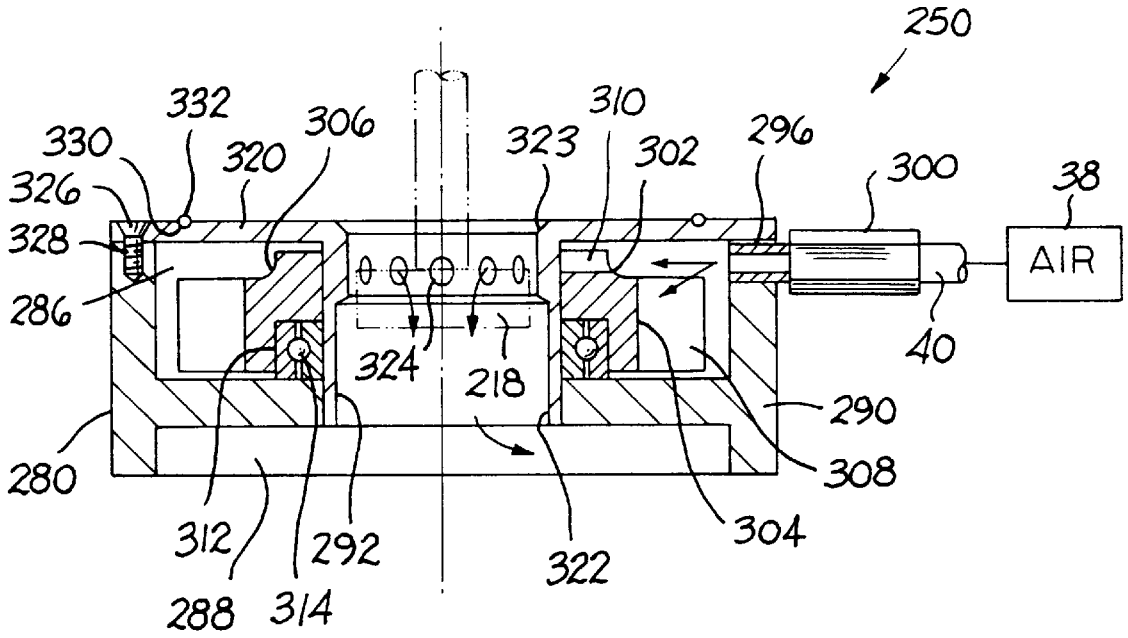
FIG. 9 is a cross-sectional view of the deflasher of FIG. 7 wherein the green body is subject to deflashing.

FIGS. 8 and 9 depict the structure of deflasher 250. Deflasher 250 includes a generally cylindrical housing 280 which has a top end 282 and a bottom end 284. As illustrated in FIG. 9, housing 280 also defines a top interior volume 286 and a bottom interior volume 288 wherein an interior wall 290 separates the interior volume of the housing into these top and bottom interior volumes (286, 288). Wall 290 contains a centrally located opening 292 therein. Housing 280 contains a port 296 in the exterior surface thereof. A fitting 300 connects to the housing 280 at the port 296. A hose 40 extends away from fitting 300 and connects deflasher 250 with a source of compressed air schematically illustrated as 38.

Deflasher 250 also has a rotor 302 which has an enlarged diameter hub portion 304 and a reduced diameter hub portion 306. Rotor 302 includes a plurality of radially outwardly extending vanes 308. The reduced diameter hub portion 306 contains an opening 310. The enlarged diameter hub portion 304 contains an annular channel 312. A bearing 314 fits within the channel 312.

Deflasher 250 includes a top cover 320 which has a central cylindrical wall 322 which defines an opening 323. Cylindrical wall 322 contains passages 324 that permit access into the volume defined by the cylindrical wall 322. Top cover 320 also contains a plurality of holes 325 near the periphery thereof. Screws 326 pass through the holes 325 so as to engage the threaded apertures 328 in the top end 282 of the housing 280. The top cover 320 further may contain an annular notch 330 which receives an O-ring 332, which seals against the surface of the picker arm 240 during the deflashing operation.

Referring to the operation of deflasher 250, compressed air (i.e., a fluid stream) flows from the compressed air source 38 through line (or hose) 40 into the deflasher 250 via fitting 300 attached to the port 296. The compressed air enters into the top interior volume 286 of the housing 280. The compressed air then continues on so as to impinge upon the rotor 302 (and specifically the rotor vanes 308), which causes the rotor 302 to rotate at a relatively high speed. The compressed air passes through the opening 310 in the reduced diameter hub portion 306 toward the passages 324 in the cylindrical wall 322 of the top cover 320.

Because there is only one opening 310 through which the compressed air passes into a plurality of passages 324, the air that exits the cylindrical wall 322 is pulsating. This pulsating stream of air impinges upon the green body 218 in such a fashion and with such force so as to dislodge the flashing and any surface debris on the green body. As mentioned earlier in conjunction with another embodiment, applicants contemplate that a continuous fluid stream could impinge the green body 218 so as to break the flashing in an acceptable fashion.

The specific arrangement illustrated in FIG. 7 also includes a disposal bin 256. During the pressing operation, the press sends a signal to a controller wherein the signal indicates if the green body 218 has been pressed in a satisfactory fashion. If the green body 218 has been pressed in a satisfactory fashion, once the green body 218 is in a position to be deflashed then the deflashing operation will proceed. If the green body 218 has not been pressed in a satisfactory fashion, once the green body 218 is in a position to be deflashed the bladder 248 at the end of the fixture pin 246 will deflate causing the green body 218 to fall through the deflasher and into the disposal bin 256.

Table I set forth below presents the results of using a deflasher like that depicted in FIGS. 7, 8, and 9. Except for Samples Nos. 10 and 11, which were subjected to deflashing for 0.3 seconds, all of the samples were subjected to deflashing for 0.5 seconds. In regard to the remarks set forth in Table I, the term C/F means a consistent flashing; the term B/G means a bottom ground cutting insert; the term GAO means a ground all over cutting insert; the term F/B means a flashed bottom cutting insert; and the term M/F means minimal flashing. The flashing was optically measured with a microscope equipped with a reticle. The description of most of the cutting insert styles was found either in the product catalog "Kennametal Lathe Tooling" (Catalog 4000) published in 1994 by Kennametal Inc. of Latrobe, Pa. 15650 or the "Lathe Tooling" (Catalog 6000) published in 1996 by Kennametal Inc. of Latrobe, Pa. 15650. Both catalogs are hereby incorporated by reference herein. The designations for Samples Nos. 13 and 24 are ISO designations for cutting inserts (see e.g., ISO 1832 "Indexable Inserts for Cutting Tools—Designation," International Organization for Standardization, Switzerland).

TABLE I

Test Results for a Deflashing of Green Bodies of Cutting Inserts

| No. | Insert Style | Grade | Deflashing Position | Flashing After Sintering (inches) | Minimum Hone Size to Clean Up Flashing (inches) | Hone Specification (inches radius) | Remarks |
|---|---|---|---|---|---|---|---|
| 10 | SPMT-432 (square screw-on) | 1 | — | .0005 | <.001 | .0005–.0015 | MF, B/G |
| 11 | CCMT-3252LF (80° diamond screw-on) | 2 | — | .001 + Top | .001R | .001–.002 | .001" F, B/G |
| 12 | CNMG432 (80° diamond Insert) | 1 | — | .005–.008 | .001 | .0015–.003 | MF-T/B |
| 13 | RCMX120400 (ISO Designation) | 3 | Bottom of hole | <.001 | <.001R | .001–.002 | MF, Even Flash |
| 14 | CNGP432K (80° diamond Insert) | 5 | Above hole | .001 Top | .0015 | .001–.002 | Excessive Flash |
| 15 | TNMG333K (triangle Insert) | 6 | Top of hole | .001 Top & Bottom | .001 | .001–.0025 | MF, Even Flash |
| 16 | TCMT3251LF (triangle screw-on) | 1 | — | .001 Top .001 + Bottom | .001 | .001–.002 | .001" F, F/B |
| 17 | DCMT3251LF (55° diamond screw-on) | 7 | Manual Tip Set | .001 Fl/.001 Rolled | .002 or higher | .001–.002 | Flash/Rolled Edge |
| 18 | DCMT3251LF (55° diamond screw-on) | 7 | Bottom of hole | .001 or less | .001R | .001–.002 | Even Flash, B/G |
| 19 | CNMG432P (80° diamond Insert) | 2 | Top of hole | .001 | .0012R | .001–.0025 | Even Flash |
| 20 | TNMG332MG (triangle Insert) | 4 | Top of hole | .0005–.001 | .001R | .0015–.003 | .001" F, T/B |
| 21 | DPBT3252LF (55° diamond screw-on) | 2 | Bottom of hole | .001 | .001 | .001–.002 | Even Flash, B/G |
| 22 | SEPR42A6GM (square milling insert) | 8 | Center of hole | .001 insert is ground | .001 | .0015–.0025 | .001" F, GAO Insert |
| 23 | SCMT432MF (square screw-on) | 5 | Bottom of hole | .001 Top (B/G insert) | .0012 | .001–.002 | .001" F, B/G |
| 24 | RCMX160600 (ISO designation) | 2 | Middle of hole | .002 | .0025 | .002–.004 | uneven Flash, Chips |
| 25 | LTB16 (triangle threading insert) | 5 | Bottom of Hole | <.001 | .001R | No Hone Required | Even Flash, GAO Insert |
| 26 | SCMT432MF (square screw-on) | 4 | Bottom of hole | <.0005 | <0.001 | .001–.002 | .0005" F, B/G |
| 27 | RCMT0602MO (round screw-on) | 9 | — | .001 Top | .001 | .0005–.0015 | .001" F, B/G |
| 28 | SCMT3251LF (square screw-on) | 2 | Bottom of hole | .0005–.001 Top | .001R | .001–.002 | .001" F, B/G |
| 29 | SCMT3251LF (square screw-on) | 2 | Bottom of hole | <.001 | .001R | .001–.002 | <.001" F, B/G |
| 30 | SCMT3251LF (square screw-on) | 2 | Top of slot | .0005 Top (C/F) | .001 | .001–.002 | C/F, B/G |
| 31 | SCMT3251LF (square screw-on) | 2 | Top of slot | .0005 Top (C/F) | .001 | .001–.002 | C/F, B/G |

In regard to the various grades used for the cutting inserts, Table II set forth below presents the nominal compositions (in weight percent) thereof wherein the balance of each composition comprised tungsten and carbon.

TABLE II

| Nominal Compositions for Grade Nos. 1–9 | | | | | |
|---|---|---|---|---|---|
| Grade | Cobalt | Ta | Ti | Nb | Other |
| 1 | 8.5 | 10.2 | 5.9 | up to 0.4 | |
| 2 | 5.8 | 5.2 | 2.0 | up to 0.4 | |
| 3 | 6.0 | 4.6 | 3.5 | 1.0 | TiN in starting mixture |
| 4 | 6.3 | 3.5 | 2.0 | 1.5 | TiN in starting mixture |
| 5 | 6.0 | up to 0.1 | up to 0.1 | up to 0.1 | 0.4 Cr |
| 6 | 7.9 | up to 0.4 | up to 0.2 | up to 0.2 | |
| 7 | 6.0 | 5.5 | 2.0 | up to 0.4 | |
| 8 | 11.5 | 1.9 | up to 0.4 | 0.4 | |
| 9 | 5.6 | 1.9 | up to 0.2 | up to 0.3 | |

The test results show that the deflashing operation resulted in a consolidated body which required a minimum hone size necessary to clean up the flashing that is at the lower end of, or even less than, the hone specification range. For example, Sample No. 11 shows that the minimum hone size needed to clean up the flashing was 0.001 inches radius which was at the lower end of the hone specification range of between 0.001 inches and 0.002 inches. Sample No. 12 shows that the minimum hone size needed to clean up the flashing was a 0.001 inches radius which was less than the lower end of the hone specification range of between 0.0015 inches and 0.002 inches.

By producing a consolidated body in which the minimum hone size needed to clean up the flashing was at or below the lower end of the hone specification range, the deflashing process produced consolidated bodies that had a better consistency from part to part. This was in contrast to the prior art air blast technique (Sample No. 17) in which the consolidated product had a minimum hone size of 0.002 inches or higher to clean up the flashing wherein the hone specification was between 0.001 and 0.002 inches. The prior art sample (Sample No. 17) also had flashing sticking up beyond the surface of the land (see the remarks which state that the flashing had a rolled edge). In regard to a comparison with the prior art Sample No. 17, Sample No. 18 reveals for the same insert style in the same grade that the deflashing process produced a consolidated body with an even flashing and which required a minimum hone size at the bottom end (0.001 inches) of the hone size specification (0.001 to 0.002 inches) to clean up the flashing.

The test results show that the deflashing operation is robust in nature. In other words, to achieve the benefits of the deflashing operation the green body does not have to be positioned at a precise position relative to the air blast. Instead, the green body need only be in vicinity of the air blast, i.e., at the top of the hole, the bottom of the hole or in the center of the hole. Sample Nos. 13, 14 and 15 demonstrate that for a sample at either the top of the hole (Sample No. 15) or at the bottom of the hole (Sample No. 13), the resultant product has an even flashing. This is in contrast to Sample No. 14 which was positioned above the hole and had excessive flashing.

After the deflashing, all of the samples had no loose powder thereon. Thus, the deflashing operation facilitates the production of a green body with no loose powder on the surface thereof. The absence of loose powder results in a consolidated (or sintered) body with better surface integrity.

Figure 12:
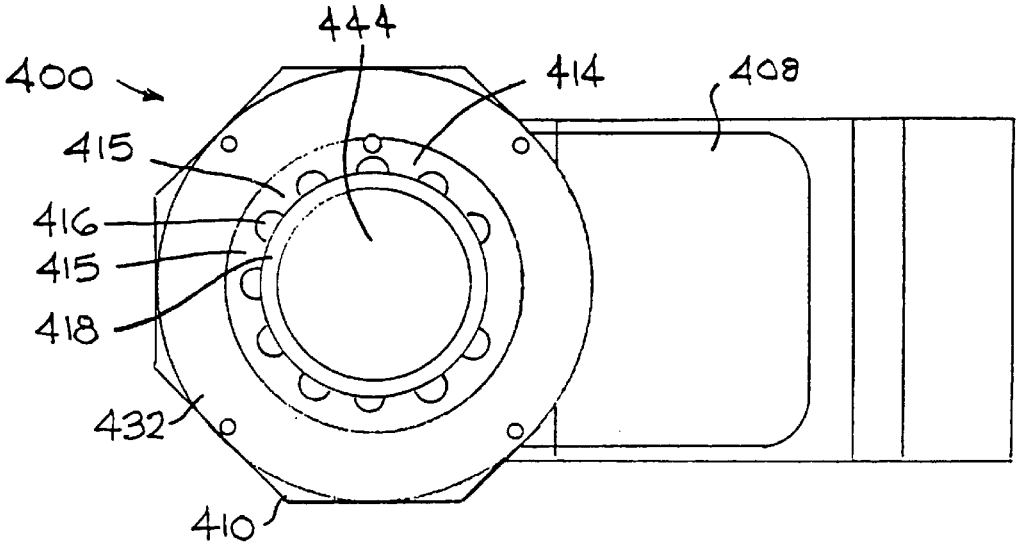
FIG. 12 is a top view of a specific embodiment of the invention which includes a motor wherein a portion of the top cover is removed to show the air sleeve and the scallop plate.
Figure 13:
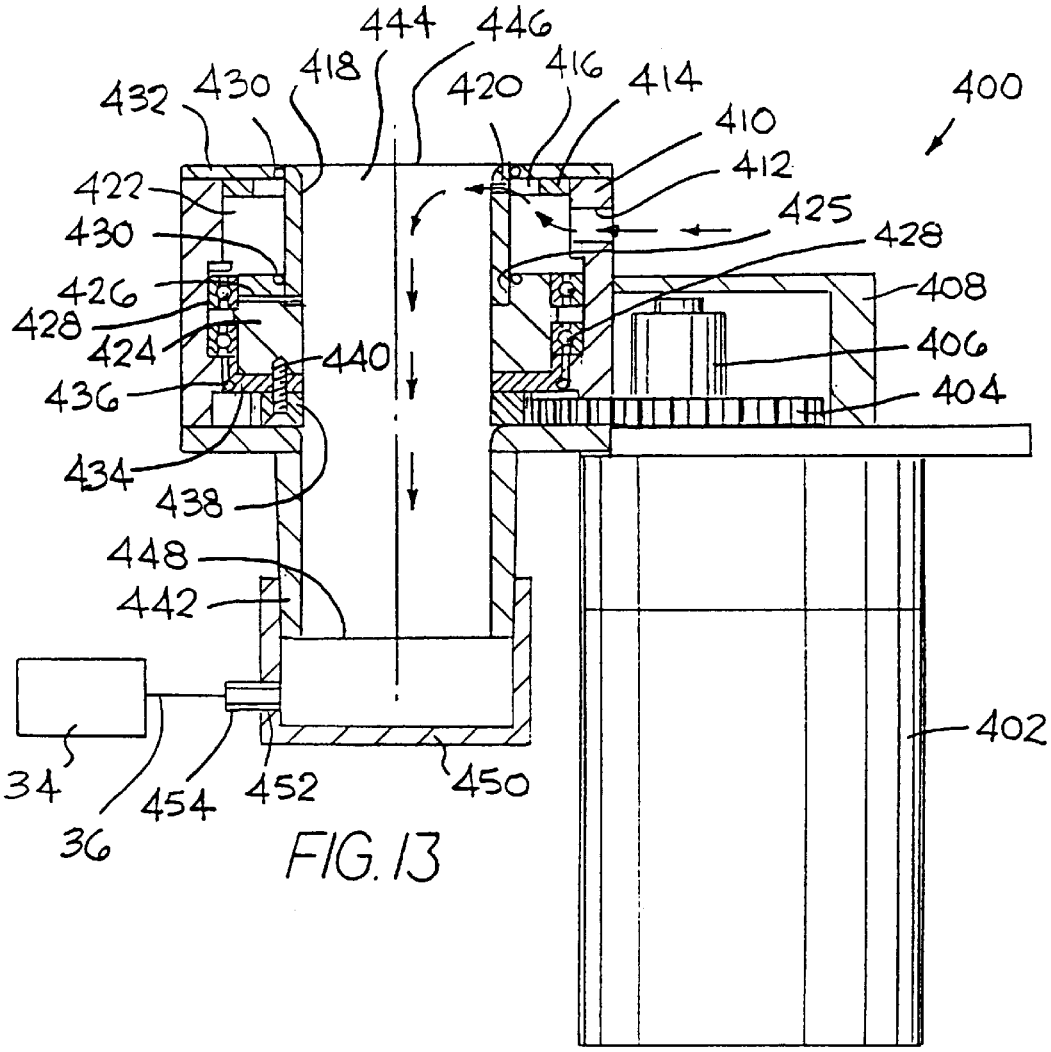
FIG. 13 is a side view of the embodiment of FIG. 12 wherein a portion of the housing and gear have been removed and a part of the interior structure shown in cross-section.

Referring to FIGS. 12 and 13, there is illustrated another embodiment of the invention wherein this embodiment comprises a motor-drive deflasher assembly, generally designated as 400. Deflasher assembly 400 includes an electric motor 402. Although the specific embodiment is an electric motor, it should be appreciated that the motor may be a fluid-drive motor (e.g., a pneumatic or hydraulic motor) or a fuel-powered motor (e.g., gasoline motor). Motor 402 drives a toothed motor gear 404, which is connected to the motor shaft by coupler 406. A gear cover 408 shields the motor gear 404 and the coupler 406. While the specific embodiment uses gears to transmit the rotational motion of the motor, the inventors contemplate the use of a belt or a chain or other means.

The deflasher assembly 400 further includes a deflasher housing 410, which houses the structure that deflashes the green body. The housing 410 includes a fluid inlet 412 which is connected to a source of pressurized fluid (not illustrated) such as, for example, air, through a hose or other conduit. At the upper end of the housing 410 there is scallop plate 414 which contains a plurality of scallops 415 therein wherein there is a gap 416 between each adjacent scallop 415. At the upper end of the housing 410 there is also an air sleeve 418 which contains a passage 420 therein adjacent to the upper end thereof. The upper end of the air sleeve 418 is encircled by the scallop plate 414. The upper portion of the housing 410 further contains a plenum 422 (or fluid entrance chamber) which is in direct communication with the fluid inlet 412.

The deflasher assembly 400 also includes a rotor 424 which has a channel 425 that receives the lower end of the air sleeve 418. The air sleeve 418 and rotor 424 are connected together by a sleeve pin 426 which passes through a small bore in the rotor 424 and into a blind bore in the air sleeve 418. The sleeve pin 426 may be a hollow elongate pin which is slit along its length so as to provide it with a transverse resiliency. There is a bearing assembly 428 that facilitates the rotational movement between the rotor 424 and the housing 410. A pair of O-rings 430 provide a seal between the exterior surface of the air sleeve 418 and the top cover 432 of the housing 410 and the rotor 424. There is a bottom plate 434 upon which the rotor 424 rests that may also include an O-ring 436 for sealing.

The deflasher assembly 400 includes a toothed rotor gear 438 which operatively engages the motor gear 404 in that the teeth of each gear (404, 438) intermesh with one another. Rotor gear 438 is secured to the bottom cover 434 and to the rotor 424 by a screw 440. The housing 410 further includes a lower projection 442. The housing 410 also includes a treating chamber 444 which extends along the longitudinal axis thereof. The treating chamber 444 has an upper end 44 and a lower end 448.

An optional feature is the canister 450 which is connected to the lower projection 442. Canister 450 may contain an outlet 462 in which there is a fitting 454. Outlet 462 is in communication with a source of vacuum 34 through a hose 36.

Referring to one typical operation, a picker arm or the like may position a green (or partially dense) body into the treating chamber 444 by passing the green body through the upper end 446 thereof. Once the green body is in position, the deflasher 400 is ready to treat the green body.

The source of pressurized air (or fluid) is in communication with the plenum 422 through the fluid inlet 412 so that the air in the plenum 422 is under pressure. When the motor 402 is activated, it operates to rotate the motor gear 404 which, in turn, causes the rotor gear 438 to rotate. Because the rotor gear 438 is connected to the rotor 424 and the air sleeve 418, the rotation of the rotor gear 438 also causes the air sleeve 418 to rotate.

As the air sleeve 418 rotates, the passage 420 at the upper end thereof comes into sequential registration (or alignment) with the scallops 415, as well as the gaps 416 that separate each scallop 415. When the passage 420 is in registration with the scallop 415, there is no path through which the pressurized air in the plenum 422 can escape. Thus, air does not enter into the treating chamber 444 from the plenum 422. When the passage 420 is in registration with a gap 416, there is a path through which the pressurized air in the plenum 422 can escape into the treating chamber 444. It thus can be appreciated that the passage 420 in the air sleeve 418 in combination with the scallops 415 and gaps 416 in the scallop plate 414 function as a valve that either permits or prohibits the flow of air from the plenum 422 (or fluid entrance chamber) into the treating chamber 444.

Because the passage 420 sequentially registers with the gaps 416, the air that enters the treating chamber 444 does so in bursts or pulses. These pulses of air pass through the deflahing chamber 444 so as to impinge upon the surface of the green body positioned within the treating chamber 444. These air pulses break the flashing, as well as help dislodge debris on the surface of the green body. The broken flashing and debris then fall into the canister 450 where they are collected and drawn away from the deflasher 400 through the hose 36 under the influence vacuum source 34.

It should be appreciated that the nature of the air pulses can vary depending upon the speed of rotation, the pressure of the air in the plenum 422, the size and spacing of the scallops 415 and the gaps 416, the size of the passage 420, and the number of passages 420. The deflasher assembly 400 could thus provide air pulses that are narrow and act as an air knife or which are broader an act as an air hammer. While the scallop plate 414 illustrates scallops 415 defined by a series of curved projections, it should be appreciated that any one of a number of configurations or combinations of configurations may be used to define the projections (e.g., angular, rectangular, sinus, etc.) where the rotation of the air sleeve 418 provides sequential communication of plenum 422 and the treating chamber 444. While the specific embodiment uses scallop plate 414, the inventors contemplate the use of air sleeve 418 without scallop plate 414 to provide a continuous air stream through passage 420 to treating chamber 444 as air sleeve 418 rotates.

It can thus be seen that the present invention provides a number of embodiments which function to break the flashing (i.e., deflash) and remove debris from a green body so as to reduce the extent of honing of the cutting edge that is necessary to finish the as-sintered body. In even broader terms, the present invention comprises an edge preparation system (or assembly) which results in an as-sintered substrate for a cutting insert with an improved honed cutting edge. Furthermore, it should be appreciated that while the specific embodiments described above pertain to deflashing one green body at a time, the inventors contemplate that the present invention has application to deflashing a plurality of green bodies at the same time. While the above description has a primary focus toward cutting inserts, it should be understood that the applicants consider the invention to encompass application to a wide variety of green bodies including, for example, green bodies formed from ceramic powders, metallic powders, polymeric powders and combinations thereof.

All patents and other documents identified in this application are hereby incorporated by reference herein.

Other embodiments of the invention will be apparent to those skilled in the art from a consideration of the specification or practice of the invention disclosed herein. It is intended that the specification and examples be considered as illustrative only, with the true scope and spirit of the invention being indicated by the following claims.

What is claimed is:

1. A method of producing a body comprising the steps of:

providing a generally homogeneous powder blend of powder components;

forming the powder blend into a partially dense body wherein the partially dense body includes a flashing; and impinging the partially dense body with a fluid stream so as to dislodge the flashing.

2. The method of claim 1 wherein the impinging step comprises impinging the partially dense body with a pulsating fluid stream.

3. The method of claim 1 wherein the impinging step comprises impinging the partially dense body with a continuous fluid stream.

4. The method of claim 1 further including the step of removing the dislodged flashing from the surface of the partially dense body.

5. The method of claim 4 wherein the removing step comprises exerting a vacuum on the partially dense body so as to draw the dislodged flashing away from the vicinity of the partially dense body.

6. The method of claim 1 further including, after the impinging step, the step of transporting the partially dense body to a preselected location.

7. The method of claim 1 further including, after the forming step and before the impinging step, the step of transporting the partially dense body to a location for performance of the impinging step.

8. The method of claim 1 further including, after the forming step and before the impinging step, the step of discarding any green body that was not satisfactorily formed.

9. The method of claim 1 further including the step of consolidating the partially dense body so as to form a consolidated body that has at least one cutting edge; and honing at least one of the cutting edges of the consolidated body.

10. The method of claim 9 further including the step of coating the consolidated body with a coating.

11. An apparatus for treating a partially dense body having a flashing wherein the partially dense body is formed by a press, the apparatus comprising:

a housing that defines a fluid entrance chamber and a treating chamber, and the housing having an opening through which the treating chamber receives the partially dense body;

the fluid entrance chamber being in communication with a source of a fluid stream, and the fluid entrance chamber being in fluid communication with the treating chamber so that the fluid stream entering the fluid entrance chamber passes into the treating chamber thereby impinging upon the partially dense body so as to break the flashing.

12. The apparatus of claim 11 wherein the housing defines an evacuation chamber, the evacuation chamber being in communication with a source of a vacuum; and the evacuation chamber being in communication with the treating chamber so that a vacuum may be exerted on the treating chamber so as to remove the broken flashing from the vicinity of the partially dense body.

13. The apparatus of claim 12 wherein a plurality of apertures provide fluid communication between the fluid entrance chamber and the treating chamber, and the apertures disperse the fluid stream as it passes between the fluid entrance chamber and the treating chamber so as to impinge substantially the entire surface of the partially dense body.

14. The apparatus of claim 13 wherein a rotor is contained within the fluid entrance chamber, the rotor having at least one opening in alignment with a selected one of the apertures so that there is fluid communication between the fluid entrance chamber and the treating chamber when the opening in the rotor is in alignment with one of the apertures; and the rotor being positioned in the fluid entrance chamber so that the fluid stream impinges thereon so as to cause the rotor to rotate thereby intermittently placing the fluid entrance chamber in communication with the treating chamber so that the fluid stream which enters the treating chamber in short bursts which impinge upon the green body so as to break the flashing.

15. The apparatus of claim 11 wherein the fluid stream that impinges the partially dense body is continuous in nature.

16. The apparatus of claim 11 wherein the housing is mounted to the press.

17. The apparatus of claim 11 wherein the housing is movable with respect to the press.

18. The apparatus of claim 11 further including a valve which selectively places the fluid entrance chamber in fluid communication with the treating chamber; and a motor operatively connected to the valve.

19. The apparatus of claim 18 wherein the valve comprises an air sleeve with a passage therein and a scallop plate presented a plurality of scallops with a gap between each one of the adjacent scallops; when the passage is in registration with one of the gaps there is communication between the fluid entrance chamber and the treating chamber; when the passage is in registration with one of the scallops there is no communication between the fluid entrance chamber and the treating chamber; and the motor rotationally driving the air sleeve so as to place the passage in sequential registration with the gaps thereby providing sequential communication between the fluid entrance chamber and the treating chamber so that pulses of the fluid enter the treating chamber.

20. An apparatus for treating and transporting a partially dense body made by a press, the apparatus comprising:

a housing that defines an entrance chamber and a treating chamber wherein the entrance chamber and the treating chamber are in fluid communication through at least one passage;

a retention member that selectively retains the partially dense body, and the retention member being movably connected to the housing so as to selectively position the partially dense body within the treating chamber;

a mover being connected to the retention member so as to selectively move the housing and retention member relative to the press;

the entrance chamber being in communication with a source of a fluid stream, and upon the fluid stream entering the entrance chamber the fluid stream passes into the treating chamber thereby impinging upon the partially dense body so as to break the flashing.

21. An apparatus for treating a partially dense body having a flashing through impingement by a fluid stream, the apparatus comprising:

a housing that defines an entrance chamber in fluid communication with a source of the fluid stream, and the housing defines a treating chamber in fluid communication with the entrance chamber so that the fluid stream may pass from the entrance chamber into the treating chamber;

a retention member that selectively retains the partially dense body in the treating chamber while the fluid stream passes into the treating chamber so as to impinge upon the partially dense body.

22. A method of producing a body comprising the steps of:

providing a generally homogeneous powder blend of powder components wherein the powder components include a hard material and a binder material;

forming the powder blend into a partially dense body for subsequent consolidation into a cutting insert body wherein the partially dense body includes a flashing; and impinging the partially dense body with a fluid stream so as to dislodge the flashing.

23. The method of claim 22 wherein the impinging step comprises impinging the partially dense body with a pulsating stream of fluid wherein the fluid comprises one of the following: a gas, a liquid, a gas with particles entrained therein, a liquid with particles entrained therein, and a liquid and a gas with particles entrained therein.

24. The method of claim 22 wherein the impinging step comprises impinging the partially dense body with a continuous stream of fluid wherein the fluid comprises one of the following: a gas, a liquid, a gas with particles entrained therein, a liquid with particles entrained therein, and a liquid and a gas with particles entrained therein.

25. The method of claim 22 further including the step of consolidating the partially dense body so as to form the cutting insert body that has at least one edge; and honing at least one of the edges of the cutting insert body so as to form a honed cutting edge.

26. The method of claim 25 wherein the honing step is carried out at a consistent radius.

27. The method of claim 25 further including the step of coating the cutting insert body with a coating.

28. The method of claim 22 wherein the hard material comprises one or more materials selected from the group comprising ceramics, cermets and carbides.

29. The method of claim 22 wherein the powder components include a hard carbide and the binder material comprises one or more selected from the group consisting of cobalt, nickel, iron, and their alloys.

30. The method of claim 22 wherein the powder components include tungsten carbide and cobalt wherein the cobalt content is between about 2 weight percent and about 20 weight percent.

31. The method of claim 30 wherein the powder components further include one or more of tantalum carbide, titanium carbide, niobium carbide and chromium carbide.

32. The method of claim 31 wherein the cobalt is between about 5.8 weight percent and about 6.5 weight percent, the tantalum is between about 3 weight percent and about 5 weight percent, the titanium is between about 1 weight percent and about 5 weight percent, the niobium is between about 0.5 weight percent and about 2.0 weight percent, and the balance is tungsten and carbon.

33. The method of claim 32 wherein the powder components further include titanium nitride.

34. The method of claim 22 wherein after completion of the formation step, the partially dense body comprises a rake face and a flank face, a rake plane lies along the rake face, the flashing extending past the rake plane, and the impinging step dislodging the flashing in such a fashion so that only the flashing which extends past the rake plane is dislodged.

35. The method of claim 34 further including the step of consolidating the partially dense body so as to form the cutting insert body that has at least one edge at the juncture of the rake face and the flank face; and honing at least one of the edges of the cutting insert body so as to form a honed cutting edge wherein the honing step is carried out at a consistent radius.

36. A press for forming a partially dense body from a mixture of powder components, the press comprising:

a top head;

a table, the table containing a die cavity therein wherein the die cavity receives the powder mixture;

an upper ram and a lower ram wherein the upper ram and the lower ram compress the powder mixture in the die cavity into a partially dense body having a rake face which lies in a rake plane, and the partially dense body having a flashing which extends past the rake plane;

an apparatus for treating the partially dense body; the treating apparatus comprising:

a housing that defines a fluid entrance chamber and a treating chamber, and the housing having an opening through which the treating chamber receives the partially dense body; and the fluid entrance chamber being in communication with a fluid stream source, and the fluid entrance chamber being in fluid communication with the treating chamber so that the fluid stream entering the fluid entrance chamber passes into the treating chamber thereby impinging upon the partially dense body so as to break the flashing.

37. The press of claim 36 wherein the only flashing broken by the fluid stream impinging on the partially dense body extends past the rake plane.

38. The press of claim 36 wherein the housing defines an evacuation chamber, the evacuation chamber being in communication with a source of a vacuum; and the evacuation chamber being in communication with the treating chamber so that a vacuum may be exerted on the treating chamber so as to remove the broken flashing from the vicinity of the partially dense body.

39. The press of claim 36 wherein a plurality of apertures provide fluid communication between the fluid entrance chamber and the treating chamber, and the apertures disperse the fluid stream as it passes between the fluid entrance chamber and the treating chamber so as to impinge substantially the entire surface of the partially dense body.

40. The press of claim 39 wherein a rotor is contained within the fluid entrance chamber, the rotor having at least one opening in alignment with a selected one of the apertures so that there is fluid communication between the fluid entrance chamber and the treating chamber when the opening in the rotor is in alignment with one of the apertures; and the rotor being positioned in the fluid entrance chamber so that the fluid stream impinges thereon so as to cause the rotor to rotate thereby intermittently placing the fluid entrance chamber in communication with the treating chamber so that the fluid stream which enters the treating chamber in short bursts which impinge upon the green body so as to break the flashing.

41. The press of claim 36 wherein the treating apparatus is mounted to the press.

42. The press of claim 36 further including a valve which selectively places the fluid entrance chamber in fluid communication with the treating chamber; and a motor operatively connected to the valve.

43. The press of claim 42 wherein the valve comprises an air sleeve with a passage therein and a scallop plate presenting a plurality of scallops with a gap between each one of the adjacent scallops; when the passage is in registration with one of the gaps there is communication between the fluid entrance chamber and the treating chamber; when the passage is in registration with one of the scallops there is no communication between the fluid entrance chamber and the treating chamber; and the motor rotationally driving the air sleeve so as to place the passage in sequential registration with the gaps thereby providing sequential communication between the fluid entrance chamber and the treating chamber so that pulses of the fluid enter the treating chamber.

44. The press of claim 36 further including a retention member that selectively retains the partially dense body, and the retention member being movably connected to the housing so as to selectively position the partially dense body within the treating chamber;

a mover being connected to the retention member so as to selectively move the housing and retention member relative to the press; and the entrance chamber being in communication with a source of a fluid stream, and upon the fluid stream entering the entrance chamber the fluid stream passes into the treating chamber thereby impinging upon the partially dense body so as to break the flashing.

45. The press of claim 44 wherein the partially dense body includes an aperture defined by a wall, and the retention member comprises an inflatable bladder wherein the bladder engages the wall defining the aperture of the partially dense body when the bladder is in an inflated condition so as to retain the partially dense body.

46. The press of claim 36 wherein the partially dense body comprises a rake face and a flank face, a rake plane lies along the rake face, the flashing extending past the rake plane, and the flashing which extends past the rake plane being the only flashing dislodged due to the impingement of the fluid stream on the partially dense body.

47. A method of producing a cutting insert comprising the steps of:

providing a generally homogeneous powder blend of powder components wherein the powder components include tungsten carbide and cobalt;

forming the powder blend into a partially dense body, the partially dense body comprising a rake face and a flank face, a rake plane lies along the rake face, the partially dense body further including a flashing extending past the rake plane;

impinging the partially dense body with a stream of gas so as to dislodge the flashing in such a fashion so that only the flashing which extends past the rake plane is dislodged;

consolidating the partially dense body under heat and pressure so as to form a cutting insert body that has at least one cutting edge at the juncture of the rake face and the flank face; and honing at least one of the cutting edges of the cutting insert body so as to form a honed cutting edge.

48. The method of claim 47 further including the step of coating the cutting insert body with a coating.

49. The method of claim 47 further including after the impinging step and before the consolidation step, the step of removing the dislodged flashing from the vicinity of the partially dense body.

50. The method of claim 47 wherein the honing step occurs at a consistent honing radius.

* * * * *